US011274489B2

(12) United States Patent
Moore, Jr. et al.

(10) Patent No.: US 11,274,489 B2
(45) Date of Patent: Mar. 15, 2022

(54) DOORS CONTAINING CORE INSERTS, AND METHOD OF MAKING THE SAME

(71) Applicant: Masonite Corporation, Tampa, FL (US)

(72) Inventors: Steven C. Moore, Jr., Lutz, FL (US); James K. Kingry, Jacksonville, FL (US); Robert C. Allen, Elburn, IL (US)

(73) Assignee: Masonite Corporation, Tampa, FL (US)

( * ) Notice: Subject to any disclaimer, the term of this patent is extended or adjusted under 35 U.S.C. 154(b) by 0 days.

(21) Appl. No.: 16/881,892

(22) Filed: May 22, 2020

(65) Prior Publication Data

US 2020/0370362 A1 Nov. 26, 2020

Related U.S. Application Data

(60) Provisional application No. 62/851,735, filed on May 23, 2019.

(51) Int. Cl.
*E06B 3/70* (2006.01)
*E06B 3/78* (2006.01)

(52) U.S. Cl.
CPC ..... *E06B 3/7001* (2013.01); *E06B 3/78* (2013.01); *E06B 2003/7023* (2013.01); *E06B 2003/7051* (2013.01)

(58) Field of Classification Search
CPC ..... E06B 3/7001; E06B 2003/7023; E06B 2003/7051; E06B 3/78
See application file for complete search history.

(56) References Cited

U.S. PATENT DOCUMENTS 3,385,002 A * 5/1968 Quinif ..... E06B 3/822 49/501
4,583,338 A * 4/1986 Sewell ..... E06B 3/7017 428/116
4,811,538 A * 3/1989 Lehnert ..... E06B 5/16 428/70
5,155,959 A * 10/1992 Richards ..... B28B 5/027 52/455
5,167,105 A * 12/1992 Isban ..... E06B 3/7001 52/309.11
5,305,577 A * 4/1994 Richards ..... B28B 1/525 52/783.13
5,875,608 A * 3/1999 Quinif ..... B32B 3/02 52/784.14

(Continued)

*Primary Examiner* — Beth A Stephan
(74) *Attorney, Agent, or Firm* — Berenato & White, LLC

(57) ABSTRACT

A method of making a door involves providing a first door facing including a first raised region and a first panel recessed from the first raised region by a first dimension, and securing a first core insert having a thickness equal to the first dimension to the first raised region. A second door facing including a second raised region and a second panel recessed from the second raised region by a second dimension is provided. A second core insert having a thickness equal to the second dimension is secured to the second raised region. A central core component is secured to the first panel and the first core insert after the first core insert has been secured to the first raised region. The second panel and the second core insert are secured to the central core component after the second core insert has been secured to the second raised region.

17 Claims, 17 Drawing Sheets

(56) References Cited

U.S. PATENT DOCUMENTS

| | | | | |
|---|---|---|---|---|
| 5,875,609 | A * | 3/1999 | Quinif | E06B 3/7001 52/784.14 |
| 5,887,402 | A * | 3/1999 | Ruggie | B32B 3/30 52/455 |
| 6,132,836 | A * | 10/2000 | Quinif | E06B 3/7017 428/116 |
| 6,619,010 | B2 * | 9/2003 | Wang Chen | E06B 3/825 49/501 |
| 7,178,308 | B2 * | 2/2007 | Fagan | B29C 51/268 52/800.1 |
| 7,426,806 | B2 * | 9/2008 | Lynch | B27N 3/08 52/309.13 |
| 10,294,711 | B2 * | 5/2019 | Ali | E06B 3/7015 |
| 2003/0084639 | A1 * | 5/2003 | Wang Chen | E06B 3/825 52/784.1 |
| 2005/0217206 | A1 * | 10/2005 | Liang | B27N 5/00 52/784.1 |
| 2006/0070347 | A1 * | 4/2006 | Gupta | E06B 5/12 52/784.1 |
| 2009/0249716 | A1 * | 10/2009 | Pfau | E06B 3/822 52/204.1 |

* cited by examiner

532

DOORS CONTAINING CORE INSERTS, AND METHOD OF MAKING THE SAME

This application claims the priority of U.S. Provisional Patent Application No. 62/851,735, filed May 23, 2019, which is incorporated herein by reference.

FIELD OF THE INVENTION

This invention relates to doors containing core inserts, and to methods of making the same.

BACKGROUND

Solid, natural wood provides aesthetic qualities that are desirable to many consumers and therefore preferred for various products. However, solid, natural wood is a relatively expensive material, and thus products made from solid, natural wood generally are more expensive than products made from alternative materials such as plastics or wood composites. As the price of natural wood has increased, the market for manufactured products that simulate natural wood has grown.

The door market is an example of a market in which natural wood has been replaced with simulated wood and other materials. Assembled doors simulating natural wood doors are well known in the art. Such doors typically include a peripheral frame and two door facings (also known in the art and referred to herein as door skins) respectively secured to opposing surfaces of the frame. The door facings may be formed from wood composite, such as hardboard, medium density fiberboard (MDF), oriented strand board, wood-plastic composites, etc. It is also known to form door facings from sheet molding compounds (SMCs) containing a thermosetting polymer and fiberglass, and from thermoplastic compounds typically reinforced with fiberglass. Steel and other metals are further examples of alternative materials from which the door facings may be made.

The entirety of the exterior surfaces of the door facings may be planar (or "flush") so as to lie in a single plane. Alternatively, the exterior surfaces of the door facings may include transition regions or contoured regions surrounding panels, which typically are either coplanar with or recessed from the main body area of the door facing surrounding the transition/contoured regions. The main body area of the door facings surrounding the panels and transition regions is often designed with woodgrain patterns arranged perpendicularly to simulate stiles and rails, as found in traditional rail-and-stile solid wood doors. The exterior surface of the door facings may be smooth, or they may be textured, for example, to provide for the appearance of woodgrain and optionally wood background tones.

Typically, the peripheral frame and the door facings define an internal cavity that may include a core. It is desirable for the core to provide rigidity and structural integrity to the door, as well as thermal and acoustic characteristics. To achieve those properties, the core often is made to fill the entire internal cavity. One way of filling the internal cavity with a core is to inject expanding foam through one or more holes drilled in the peripheral frame, and allow the foam to expand and cure. However, the use of expanding foam can increase manufacturing and tooling costs and lead to prolonged production times.

Another option for filling the internal cavity of the door is to provide a prefabricated solid core. But prefabricated solid cores require machining (e.g., routing) or other shaping of the opposing surfaces of the core to match thickness variations in the internal cavity due to the contours of the transition regions and recessing of the panels of the door facings. Such machining of the prefabricated solid core is labor intensive and time consuming.

Another problem with prefabricated solid cores is that the cores cannot be universally applied to a wide variety of door designs. Door manufacturers often offer various, extensive door facing options, including different numbers of panels, different panel shapes, and different panel arrangements. It is expensive from a manufacturing standpoint to prepare and stock multiple different prefabricated solid cores, each tailored for a particular combination of such options. It would be a significant improvement to provide a method of assembling cores from core components, such as universal core components, that can be used for a wide variety of doors and door options.

SUMMARY OF THE INVENTION

A first aspect of the invention provides a method of making a door. A first door facing including a first raised region and a first recessed panel recessed from the first raised region by a first dimension is provided. A first core insert having a first thickness equal to the first dimension is secured to the first raised region. A second door facing including a second raised region and a second recessed panel recessed from the second raised region by a second dimension is provided. A second core insert having a second thickness equal to the second dimension is secured to the second raised region. A central core component is secured to the first recessed panel and the first core insert after the first core insert is secured to the first raised region. The second recessed panel and the second core insert secured thereto are secured to the central core component.

A second aspect of the invention provides a method of making a door, including a step of providing a first door facing having a first interior surface and an opposite first exterior surface, the first door facing including a first raised region, a first transition region surrounded by the first raised region, and a first recessed panel surrounded by the first transition region and recessed from the first raised region by a first dimension. A first core insert including a first inner surface, an opposite first outer surface, and a first thickness extending between the first inner surface and the first outer surface equal to the first dimension is provided. The first outer surface of the first core insert is secured to the first raised region so that the first core insert is positioned outside of the first recessed panel. Also provided is a second door facing having a second interior surface and an opposite second exterior surface, the second door facing including a second raised region, a second transition region surrounded by the second raised region, and a second recessed panel surrounded by the second transition region and recessed from the second raised region by a second dimension. A second core insert including a second inner surface, an opposite second outer surface, and a second thickness extending between the second inner surface and the second outer surface equal to the second dimension is provided. The second outer surface of the second core insert is secured to the second raised region so that the second core insert is positioned outside of the second recessed panel. A central core component is secured to the first recessed panel and the first inner surface of the first core insert after having secured the first outer surface of the first core insert to the first raised region. The second recessed panel and the second inner surface of the second core insert are secured to the central core component after having secured the second outer surface of the second core insert to the second raised region.

A third aspect of the invention provides a door including a door frame, first and second door facings, and a core. The first door facing has a first interior surface secured to a first door frame surface and an opposite first exterior surface, the first door facing including a first raised region, a first transition region surrounded by the first raised region, and a first recessed panel surrounded by the first transition region and recessed from the first raised region by a first dimension. The second door facing has a second interior surface secured to a second door frame surface and an opposite second exterior surface, the second door facing including a second raised region, a second transition region surrounded by the second raised region, and a second recessed panel surrounded by the second transition region and recessed from the second raised region by a second dimension. The core includes a first core insert, a second core insert, and a central core component. The first core insert includes a first inner surface, an opposite first outer surface secured to the first raised region, and a first thickness extending between the first inner surface and the first outer surface equal to the first dimension. The second core insert includes a second inner surface, an opposite second outer surface secured to the second raised region, and a second thickness extending between the second inner surface and the second outer surface equal to the second dimension. The central core component has a first surface secured to the first recessed panel and the first inner surface of the first core insert, and an opposite second surface secured to the second recessed panel and the second inner surface of the second core insert. The first core insert is spaced from the first transition region and the first recessed panel to provide a first space between the central core component and the first raised region that is unfilled by the first core insert. The second core insert is spaced from the second transition region and the second recessed panel to provide a second space between the central core component and the second raised region that is unfilled by the second core insert.

A fourth aspect of the invention provides a method of making a door, comprising securing a first outer surface of a first core insert to a first interior surface of a first door facing, securing a second outer surface of a second core insert to a second interior surface of a second door facing, securing a first surface of a central core component to a first inner surface of the first core insert after said securing of the first outer surface of the first core insert to the first interior surface of the first door facing, and securing a second inner surface of the second core insert to a second surface of the central core component after said securing of the second outer surface of the second core insert to the second interior surface of the second door facing.

A fifth aspect of the invention provides a method of making a door, comprising securing first outer surfaces of first core inserts to a first interior surface of a first door facing, securing second outer surfaces of second core inserts to a second interior surface of a second door facing, securing frame members to the first interior surface of the first door facing after said securing of the first outer surfaces of the first core inserts to the first interior surface of the first door facing, and securing second inner surfaces of the second core inserts to first inner surfaces of the first core inserts and securing the second interior surface of the second door facing to the frame members after said securing of the second outer surfaces of the second core inserts to the second interior surface of the second door facing, wherein the first and second inserts have a combined thickness equal to a thickness of the frame members.

A sixth aspect of the invention provides a method of making a door, comprising securing first surfaces of core inserts to a first interior surface of a first door facing, securing frame members to the first interior surface of the first door facing after said securing of the first surfaces of the core inserts to the first interior surface of the first door facing, and securing a second interior surface of a second door facing to the frame members and second surfaces of the core inserts after said securing of the first surfaces of the core inserts to the first interior surface of the first door facing, wherein the inserts have a thickness equal to a thickness of the frame members.

A seventh aspect of the invention provides a door including a door frame, first and second door facings, and a core. The first door facing has a first interior surface secured to a first door frame surface and an opposite first exterior surface, the first door facing including a first raised region and a first recessed region that is recessed from the first raised region. The second door facing has a second interior surface secured to a first door frame surface and an opposite first exterior surface, the first door facing including a second raised region and a second recessed region that is recessed from the second raised region. The core includes a plurality of core inserts secured to the first and inner surfaces at the raised region.

An eight aspect of the present invention provides a method of making the door of the seventh aspect. The method comprising securing core inserts to a first interior surface of the first door facing at the raised region, securing frame members to the first interior surface of the first door facing, and securing the second interior surface of the second door facing on to the core inserts so that the interior surfaces of the first and second door facings face each other.

Other aspects of the invention, including cores, components, assemblies, kits, methods, processes, and the like which constitute part of the invention, will become more apparent upon reading the following detailed description of the exemplary embodiments.

BRIEF DESCRIPTION OF THE DRAWING(S)

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF THE EXEMPLARY EMBODIMENTS AND EXEMPLARY METHODS

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods.

Figure 3:
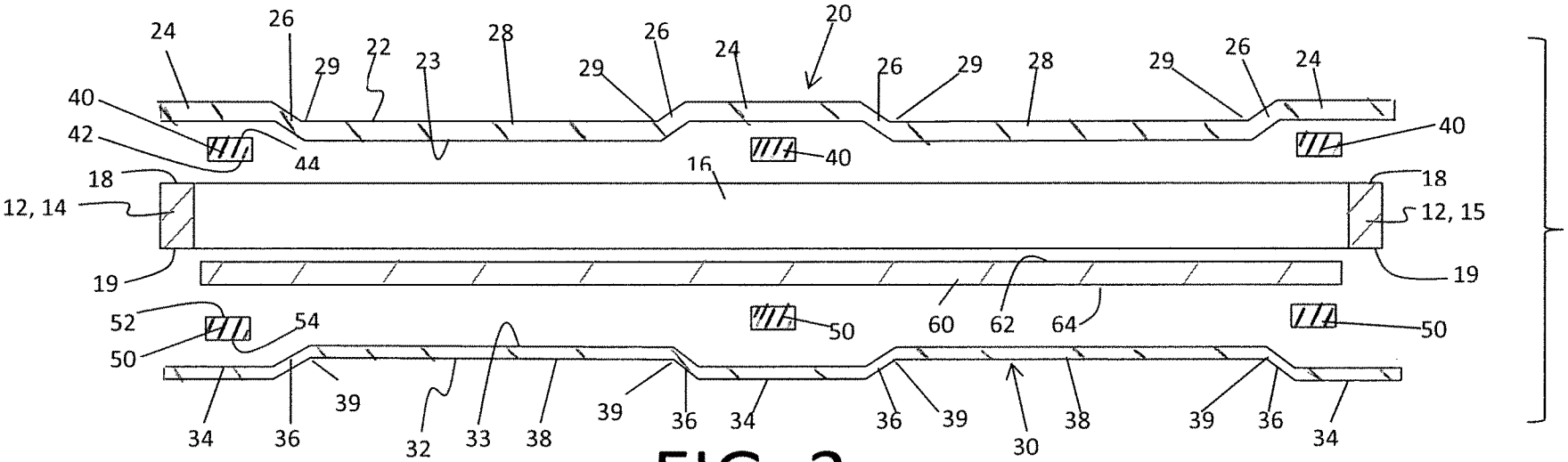
FIG. 3 is an exploded view of FIG. 2.
Figure 4:
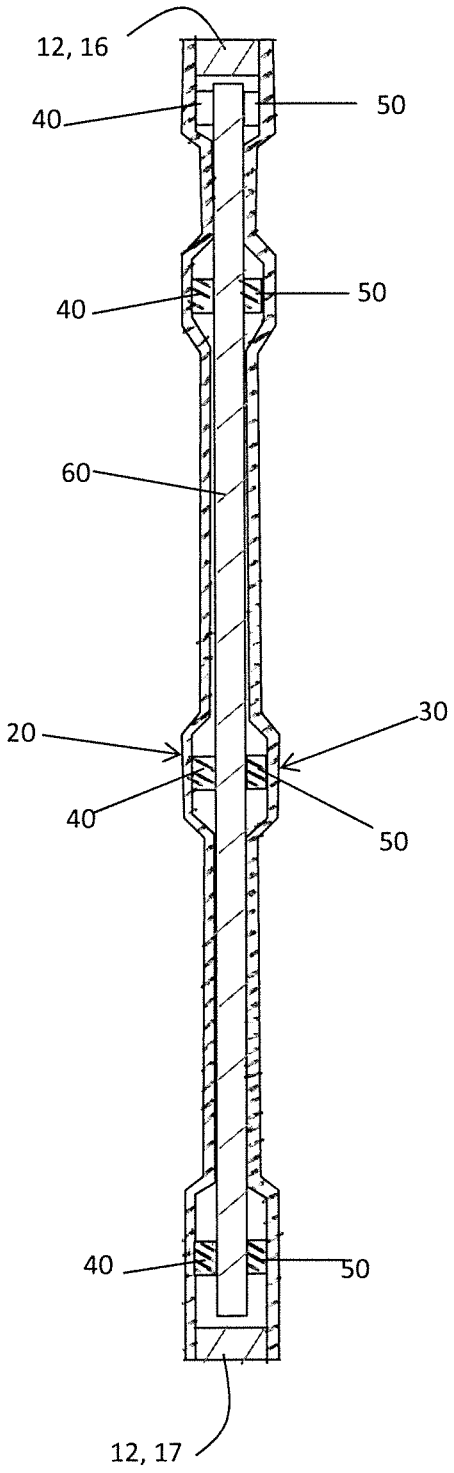
FIG. 4 is a vertical cross-sectional view of the door of FIG. 1 taken along line 4-4 and viewed in the direction of the arrows.
Figure 5:
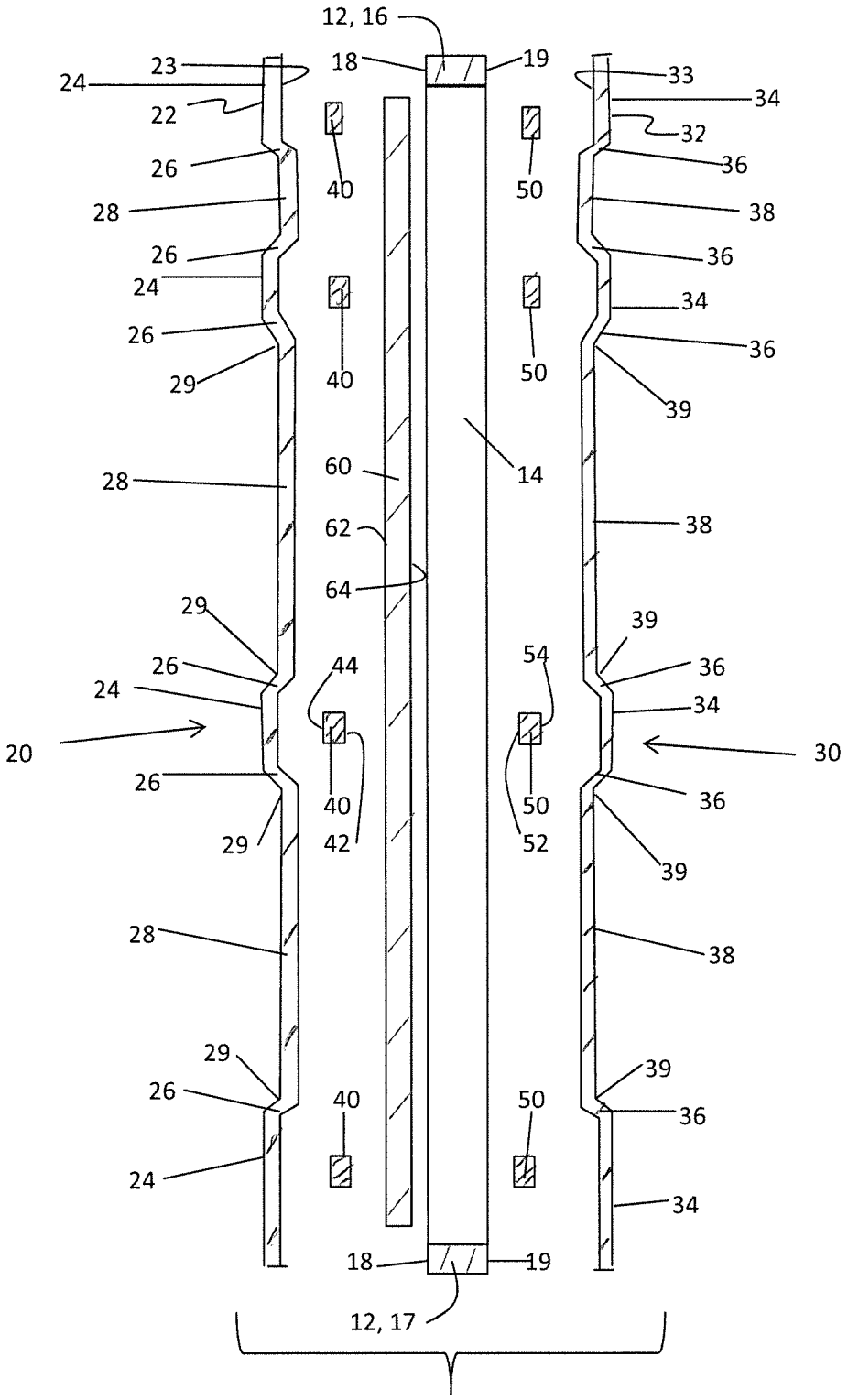
FIG. 5 is an exploded view of FIG. 4.

As best shown in FIGS. 1 through 5, a door 10 includes a peripheral frame 12. The frame 12 includes stiles 14 and 15 (shown in the cross section of FIGS. 2 and 3) and top and bottom rails 16 and 17 (shown in cross section in FIGS. 4 and 5) connecting the ends of the stiles 14 and 15. Although not shown, the frame 12 may include intermediate stiles (extending between and parallel to the stiles 14 and 15) and/or intermediate rails (extending between and parallel to the rails 16 and 17). The frame 12 may also include one or more lock blocks and hinge blocks. As best shown in FIGS. 3 and 5, the frame 12 has a first surface 18 and a second surface 19 opposite to the first surface 18. The frame 12 may be made of, for example, wood, metal, composite, other materials, or a combination thereof.

The door 10 further comprises a first door facing 20 and a second door facing 30. The first and second door facings 20 and 30 may be made of, for example, wood composite, fiberglass-reinforced thermoset, such as a sheet molding compound (SMC), fiberglass-reinforced thermoplastic, steel, or other materials. The first and second door facings 20 and 30 are typically made of the same materials and typically are identical to one another, including having the same appearance and thickness.

As best shown in FIGS. 3 and 5, the first door facing 20 has a first exterior (or exteriorly disposed) surface 22 and an opposite first interior (or interiorly disposed) surface 23. The first interior surface 23 is secured at its periphery to the first surface 18 of the frame 12. Similarly, the second door facing 30 has a second exterior (or exteriorly disposed) surface 32 and an opposite second interior (or interiorly disposed) surface 33. The second interior surface 33 is secured at its periphery to the second surface 19 of the frame 12. The first and second exterior surfaces 22 and 32 face way from (oppose) one another, while the first and second interior surfaces 23 and 33 face toward one another. The first and second door facings 20 and 30 may be secured to the first and second surfaces 18 and 19 of the frame 12 using adhesive, mechanical fasteners, a combination thereof, or another suitable securing technique.

Figure 1:
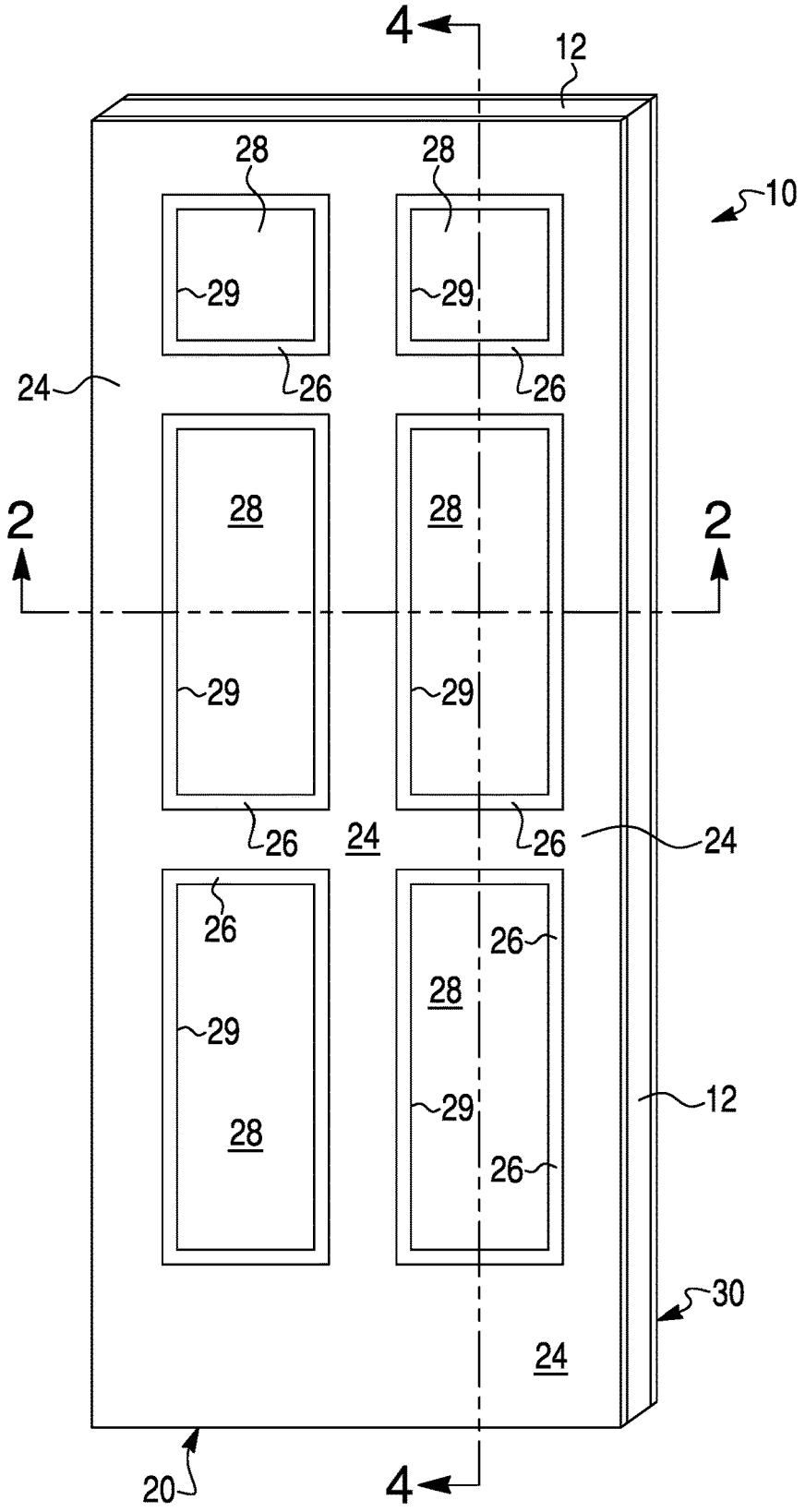
FIG. 1 is a front perspective view of a door according to an embodiment of the invention.
Figure 2:
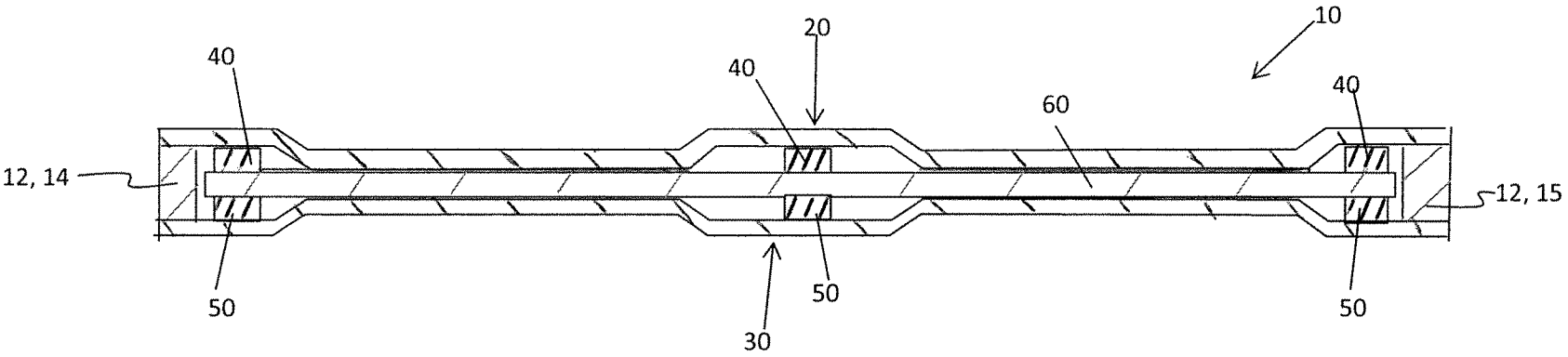
FIG. 2 is a horizontal cross-sectional view of the door of FIG. 1 taken along line 2-2 and viewed in the direction of the arrows.

As best shown in FIGS. 1, 3, and 5, the first door facing 20 comprises a first raised region (or first main body) 24 that is planar and extends in a first plane (unnumbered). The first raised region 24 defines "stile" areas and "rail" areas. In particular, there are three "stile" areas (FIGS. 1-3) coplanar with one another and extending the entirety of the length (or height) of the first door facing 20, and four "rail" areas (FIGS. 1, 4, and 5) coplanar with one another and extending between and perpendicular to the outermost stile areas.

Again referring to FIGS. 1, 3, and 5, the first door facing 20 further comprises continuous/endless first transition regions 26 recessing from, surrounded by and immediately adjacent to and contiguous with the first raised region 24, and first recessed panels 28. The first transition regions 26 are interposed between and connect the first raised region 24 to the first recessed panels 28. The first recessed panels 28 are planar and terminate at opposite sides and opposite ends thereof at first continuous planar outer perimeters 29. An entirety of each of the first recessed panels 28 within its corresponding first continuous planar outer perimeter 29 is planar and lies in a second plane (unnumbered) that is parallel to and recessed from the first plane of the first raised region 24. The first recessed panels 28 are each surrounded by and have an entirety of the first continuous planar outer perimeter 29 immediately adjacent to and contiguous with a corresponding one of the first transition regions 26. The first raised region 24, the first transition regions 26, and the first recessed panels 28 are preferably integrally formed with one another to constitute a single piece. The first transition regions 26 and the first recessed panels 28 may be shaped using a molding process, such as compression molding.

The second door facing 30 comprises a second raised region (or second main body) 34 that is planar and lies in a third plane (unnumbered) parallel to the first and second planes. The second door facing 30 is identical to the first door facing 20. Accordingly, the second raised region 34 defines "stile" areas and "rail" areas in the same manner as described above with respect to the first raised region 24 of the first door facing 20. The second door facing 30 comprises continuous/endless second transition regions 36 and second recessed panels 38 having the same characteristics as the first transition regions 26 and the first recessed panels 28, respectively, as described above.

The first and second door facings 20 and 30 of the embodiment of FIGS. 1-5 have identical configurations, as best shown in the cross-sectional views of FIGS. 2-5. The first recessed panels 28 are each aligned with a corresponding one of the second recessed panels 38, the first transition regions 26 are each aligned with corresponding second transition regions 36, the first continuous planar outer perimeters 29 are each aligned with corresponding second continuous planar outer perimeters 39.

Although the first and second door facings 20 and 30 are each shown with six (6) recessed panels 28 and 38 and six (6) of the surrounding transition regions 26 and 36, it should be understood that the door facings 20 and 30 may include one, two, three, four, five, or more recessed panels and surrounding transition regions. The door facings 20, 30 may have the appearance of a "shaker" door. While the panels 28 are shown as being rectangular, those skilled in the art will recognize that they may have any configuration, such as being oval.

As best shown in FIGS. 3 and 5, the first transition regions 26 extend inwardly relative to the first exteriorly disposed surface 22 from the first raised region 24 to surround the first recessed panels 28 and integrally connect the first recessed panels 28 to the first raised region 24. Likewise, the second transition regions 36 extend inwardly relative to the second exteriorly disposed surface 32 from the second raised region 34 to surround the second recessed panels 38 and integrally connect to the second recessed panels 38 to the second raised region 34. The first and second transition regions 26 and 36 are shown having linear profiles at oblique angles to the first and second raised regions 24 and 34 and the first and second recessed panels 28 and 38. Alternatively, the first and second transition regions 26 and 36 may be perpendicular to the first and second raised regions 24 and 34 and the first and second recessed panels 28 and 38. Shaker-style doors are a popular design and have relatively steep transition regions 26, 36 approaching perpendicular to the first and second raised regions 24 and 34. In other embodiments, the first and second transition regions 26 and 36 may be non-linear, such as contoured, for example, as a bead-and-cove configuration.

Although the embodiment shown in FIGS. 1-5 includes first and second door facings 20 and 30 having an identical configuration, it should be understood that the door facings 20 and 30 may have different configurations from one another.

Referring now to FIGS. 2-5, the door 10 further includes a core comprising a plurality of first core inserts 40, a plurality of second core inserts 50, and a central core component 60.

The central core component 60 is positioned between the first interior surface 23 of the first door facing 20 and the second interior surface 33 of the second door facing 30. The central core component 60 includes opposite first and second surfaces 62 and 64. Preferably, the first and second surfaces 62 and 64 are planar, and the central core component 60 has a uniform thickness over its entire length and width.

The first surface 62 contacts the inner surfaces 23 of the first recessed panels 28 (optionally yet preferably with adhesive therebetween), and is spaced from the inner surfaces 23 of the first raised region 24 and the first transition regions 26. Likewise, the second surface 64 contacts the inner surfaces 33 of the second recessed panels 38 (optionally yet preferably with adhesive therebetween), and is spaced from the inner surfaces 33 of the second raised region 34 and the second transition regions 36.

The first core inserts 40 are positioned between the first raised region 24 and the first surface 62 of the central core component 60, and outside the areas between the first surface 62 of the central core component 60 and the first transition regions 26 or the first recessed panels 28. Each of the first core inserts 40 has a first inner surface 42 contacting the first surface 62 of the central core component 60 (optionally yet preferably with adhesive therebetween), and an opposite first outer surface 44 contacting the interior surface 23 of the first raised region 24 (optionally yet preferably with adhesive therebetween). Preferably, the first core inserts 40 are spaced from the first transition regions 26 and the first recessed panels 28 to provide spaces between the first surface 62 of the central core component 60 and the first raised region 24/first transition regions 26 that are unfilled by the first core inserts 40.

Each of the first core inserts 40 has a first thickness extending between the first inner surface 42 and the first outer surface 44. The first thickness preferably is equal to a first recess distance (or dimension) that the first plane in which the inner surface 23 of the first raised region 24 lies is spaced from the second plane in which the inner surfaces 23 of the first recessed panels 28 lie. The first inner surface 42 preferably is coplanar with the interior surface 23 of the first recessed panels 28. It is also preferable for the first thickness of the first core inserts 40 to be constant or uniform over the entire length and width of the first core inserts 40.

The second core inserts 50 are positioned between the second raised region 34 and the second surface 64 of the central core component 60, and outside the areas between the second surface 64 of the central core component 60 and the second transition regions 36 or the second recessed panels 38. Each of the second core inserts 50 has a second inner surface 52 contacting the second surface 64 of the central core component 60 (optionally yet preferably with adhesive therebetween), and an opposite second outer surface 54 contacting the interior surface 33 of the second raised region 34 (optionally yet preferably with adhesive therebetween). Preferably, the second core inserts 50 are spaced from the second transition regions 36 and the second recessed panels 38 to provide spaces between the second surface 64 of the central core component 60 and the second raised region 34/second transition regions 36 that are unfilled by the second core inserts 50. Also preferably, the second core inserts 50 are aligned with the first core inserts 40 on the opposite side of the central core component 60.

Each of the second core inserts 50 has a second thickness extending between the second inner surface 52 and the second outer surface 54. The second thickness preferably is equal to a second recess distance (or dimension) that the third plane in which the inner surface 33 of the second raised region 34 lies is spaced from the fourth plane in which the inner surfaces 33 of the second recessed panels 38 lie. The second inner surface 52 preferably is coplanar with the interior surface 33 of the second recessed panels 38. Preferably, the second thickness of the second core inserts 50 is constant over the entire length and width of the second core inserts 50.

The first and second core inserts 40 and 50 provide added support between the door facings 20 and 30 and the central core component 60. While the first and second raised regions 24 and 34 remain spaced from the central core component 60, the core inserts 40 and 50 create indirect contact between the raised regions 24 and 34 and the central core component 60 by having the thickness of the core inserts 40 and 50 equal to the distance that the recessed panels 28 and 38 are recessed from the raised regions 24 and 34, respectively. The core inserts 40 and 50 thereby supplement the effective abutment interface between the first and second recessed panels 28 and 38 and the central core component 60 to enhance the structural integrity of the door 10 and reduce the susceptibility of the door facings 20 and 30 to distortion such as bowing, warping, oil-canning, and twisting, especially when the door facings 20 and 30, the core inserts 40 and 50, and the central core component 60 are adhesively secured to one another and subject to moisture differences.

The first thickness of the first core inserts 40, the second thickness of the second core inserts 50, and the first and second recess distances (or dimensions) typically are in a range of 0.250 inch (0.9525 cm) to 0.625 inch (1.5875 cm), especially 0.375 inch (0.9525 cm).

As referred to herein, equal thicknesses and distances/dimensions should be understood to include small thickness differences sufficient to accommodate adhesive and/or to accommodate manufacturing tolerances for variations in the thickness of the door parts. For example, the first core insert 40 may be slightly smaller than the first recess distance to accommodate adhesive between the outer surface 44 of the first core insert 40 and the interior surface 23 of the first door facing 20, and between the inner surface 42 of the first core insert 40 and the central core component 60. The second core insert 50 may be slightly smaller than the second recess distance to accommodate adhesive between the outer surface 54 of the second core component 50 and the interior surface 33 of the second door facing 30, and between the inner surface 52 of the second core component 50 and the central core component 60.

Figure 6A:
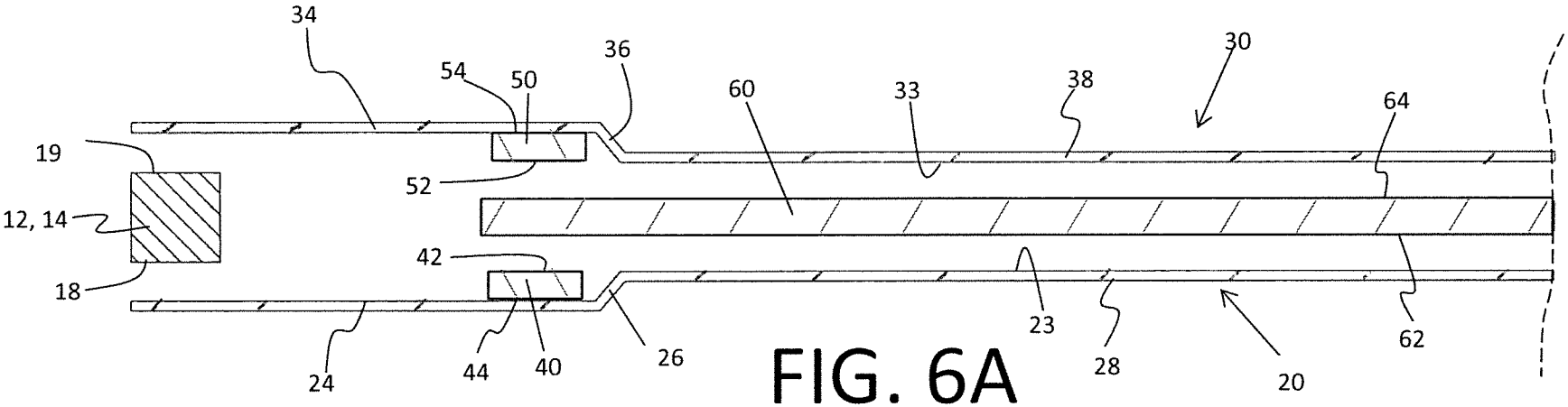
FIGS. 6A and 6B are fragmented sectional views of the door of FIGS. 1-5 at different processing stages according to an exemplary embodiment.
Figure 6B:
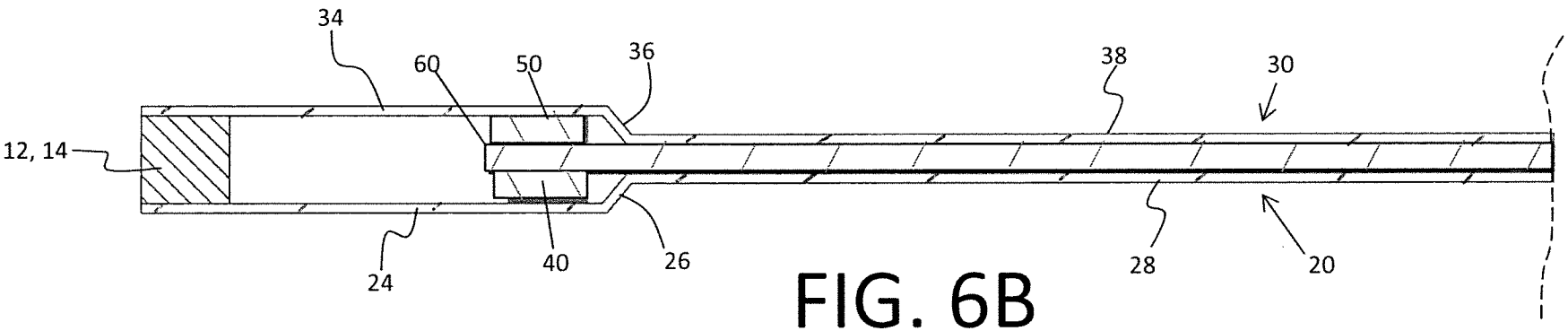

According to the exemplary method of FIGS. 6A and 6B, the first outer surfaces 44 of the first core inserts 40 are secured to the interior surface 23 of the first raised region 24, and the second outer surfaces 54 of the second core inserts 50 are secured to the interior surface 33 of the second raised region 34. The first door facing 20 is laid flat on the floor or a manufacturing table with the first interior surface 23 facing upward. The first surface 18 of the frame 12 is placed on and secured to the interior surface 23 of the first door facing 20, preferably about the perimeter of the first raised region 24 of the first door facing 20. Alternatively, the frame 12 may be placed within the perimeter of the first raised region 24, and the door facing 20 (and the door facing 30) may be subject to post-assembly trimming to remove material extending beyond the frame 12. After the first core inserts 40 and the frame 12 have been secured to the interior surface 23 of the first door facing 20, the first surface 62 of the central core component 60 is secured to the interior surfaces 23 of the first recessed panels 28 and to the first inner surfaces 42 of the first core inserts 40. Next, the second door facing 30 with the second core inserts 50 already secured thereto are laid on and secured to the second surface 19 of the frame 12 and the second surface 64 of the central core component 60.

Figure 7:
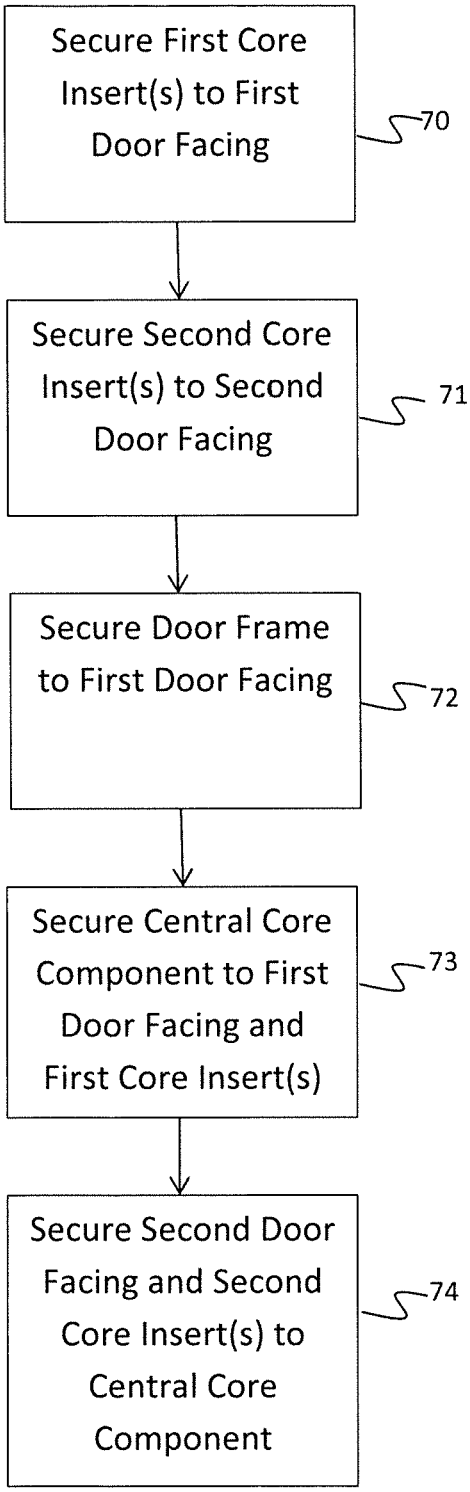
FIG. 7 is a flowchart illustrating an exemplary method according to an embodiment of the invention.

FIG. 7 is a flowchart of another exemplary method of the invention. The first outer surfaces 44 of the first core inserts 40 are secured to the first interior surface 23 of the first raised region 24, as indicated in step 70 of FIG. 7. In step 71, the second outer surfaces 54 of the second core inserts 50 are secured to the second interior surface 33 of the second raised region 34. In step 72, the first surface 18 of the frame 12 is secured to the interior surface 23 of the first door facing 20, preferably about the perimeter of the first raised region 24 of the door skin 20. The first planar surface 62 of the central core component 60 is secured to the interior surfaces 23 of the first recessed panels 28 and to the first inner surfaces 42 of the first core inserts 40, as indicated in step 73. In step 74, the second door facing 30 and the second core inserts 50 already secured thereto are laid on and secured to the second surface 19 of the frame 12 and the second planar surface 64 of the central core component 60.

Figure 8:
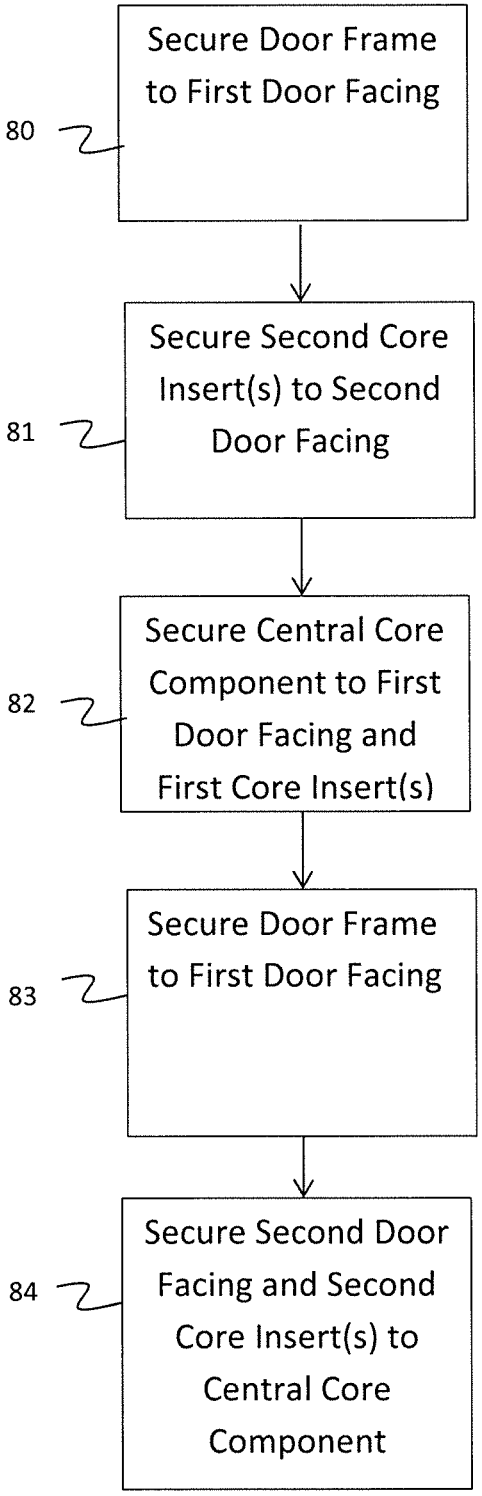
FIG. 8 is a flowchart illustrating another exemplary method according to another embodiment of the invention.

FIG. 8 is a flowchart of another exemplary method of the invention. The flowchart of FIG. 8 is identical to that of FIG. 7, except that the central core component is secured to the first door facing and the first core inserts before the door frame 12 is secured to the interior surface 23 of the first door facing 20. Thus, steps 80-84 correspond to steps 70, 71, 73, 72, and 74, respectively.

The application of the first core inserts 40 to the first door facing 20 and the second core inserts 50 to the second door facing 30 may be performed manually or automatically using, for example, robotic arms. Similarly, the application of the central core component 60 to the interior surfaces 23 of the first recessed panels 28 and to the first inner surfaces 42 of the first core inserts 40 may be performed manually or automatically using, for example, robotic arms.

The inventors have found that assembly time can be reduced by applying and securing the first core inserts 40 to the first door facing 20 around part or all of the first recessed panels 28 prior to securing the first door facing 20 to the central core component 60 (and preferably prior to securing the first door facing 20 to the frame 12), and by applying and securing the second core inserts 50 to the second door facing 30 around part or all of the second recessed panels 38 prior to securing the second door facing 30 to the central core component 60 and to the frame 12.

In particularly exemplary embodiments, the thickness of the first core inserts 40 matches the recessed distance (between first and second parallel planes discussed above) of the first recessed panels 28 so that the interior surfaces 23 of the first recessed panels 28 and the inner surfaces 42 of the first core inserts 40 lie in a common plane. In this manner, the first planar surface 62 of the central core component 60 does not require shaping, such as the machining of cavities or channels, to mate with the coplanar surfaces 23 and 42 of the first recessed panels 28 and the first core inserts 40.

Similarly, in exemplary embodiments the thickness of the second core inserts 50 matches the recessed distance (between third and fourth parallel planes discussed above) of the second recessed panels 38 so that the interior surfaces 33 of the second recessed panels 38 and the inner surfaces 52 of the second core inserts 50 lie in a common plane. In this manner, the second planar surface 64 of the central core component 60 does not require shaping, such as the machining of cavities or channels, to mate with the coplanar surfaces 33 and 52 of the second recessed panels 38 and the second core inserts 50. Accordingly, a "universal core" may be selected as the central core component 60 without regard for the recessed panel arrangements of the door facings 20 and 30.

Preferably, the central core component 60 and the first and second core inserts 40 and 50 establish a three-layer core structure between the door facings 20 and 30. The first core inserts 40 may have the same or different shapes as one another. Similarly, the second core inserts 50 may have the same or different shapes as one another. The first core inserts 40 may have the same or different shapes as the second core inserts 50.

The core inserts 40 and 50 and the central core component 60 may be made of the same material as one another or of different materials from one another. Examples of suitable materials include corrugated paper, corrugated plastic, medium density fiberboard (MDF), polymeric foam, and/or particleboard. It should be understood that the core inserts 40 and 50 themselves may comprise multi-layer structures.

In a particularly exemplary embodiment of the invention, the first core inserts 40 and/or the second core inserts 50 are made of expanded polystyrene foam material. Core inserts 40 and 50 could also be made from other polymeric foams, such as extruded polystyrene foam, polypropylene foam, polyethylene foam, or polyurethane foam. Alternatively, door facing material, such as door facing waste material, which may comprise MDF or other door facing materials described herein may be used to form the core inserts 40, 50. Because the door facings typically have a smaller thickness than the desired thickness of the core inserts 40 and 50, the core inserts 40 and 50 may be shaped to include corrugations, honeycombs, or other shapes that increase their effective thickness. Similarly, the core inserts 40 and 50 may be shaped from a thin plastic sheet to include corrugations, honeycombs, or other shapes that increase their effective thickness. The material of the core inserts 40, 50 preferably is provided in solid form and may be cut to size as needed in order to fit the door 10 or may be a uniform length, width and thickness.

The securing of the door facings 23, 30 described herein is preferably performed with an adhesive. Exemplary adhesives include hot melt adhesive and polyvinyl acetate (PVA), either alone or in combination with one another, for securing the core inserts 40 and 50 and the central core component 60 to one another, to the door facings 20 and 30, and to the frame 12. The combination of hot melt adhesive and PVA allows the parts to be secured in place in a very short amount of time while preferably using a minimum amount of hot melt adhesive. Other adhesives such as ethylene vinyl acetate may be used in place of PVA.

The adhesive is preferably applied to the opposite planar surfaces 62 and 64 of the central core component 60, and to the interior surfaces 23 and 33 of the first and second recessed panels 28 and 38 in the regions where core inserts 40 and 50 will be bonded, but not on the inner surfaces 42 and 52 of the first and second core inserts 40 and 50. This application method reduces production time and cost. A glue spreader or other device may be used to apply the adhesive to the opposite planar surfaces 62 and 64 of the central core component 60. A glue applicator on a robotic arm may be used to apply the adhesive to the interior surfaces 23 and 33 of recessed panels 28 and 28 in the regions where core inserts 40 and 50 will be adhered.

As discussed above, the core inserts 40 and 50 complement the central core component 60 to provide additional structural support and create a door that is more resistant to distortion, such as warping.

The principles of the invention may be applied to door facings having various panel configurations and arrangements. FIGS. 9-12 illustrate partially assembled doors according to additional exemplary embodiments.

Figures 9, 10, 11, 12:
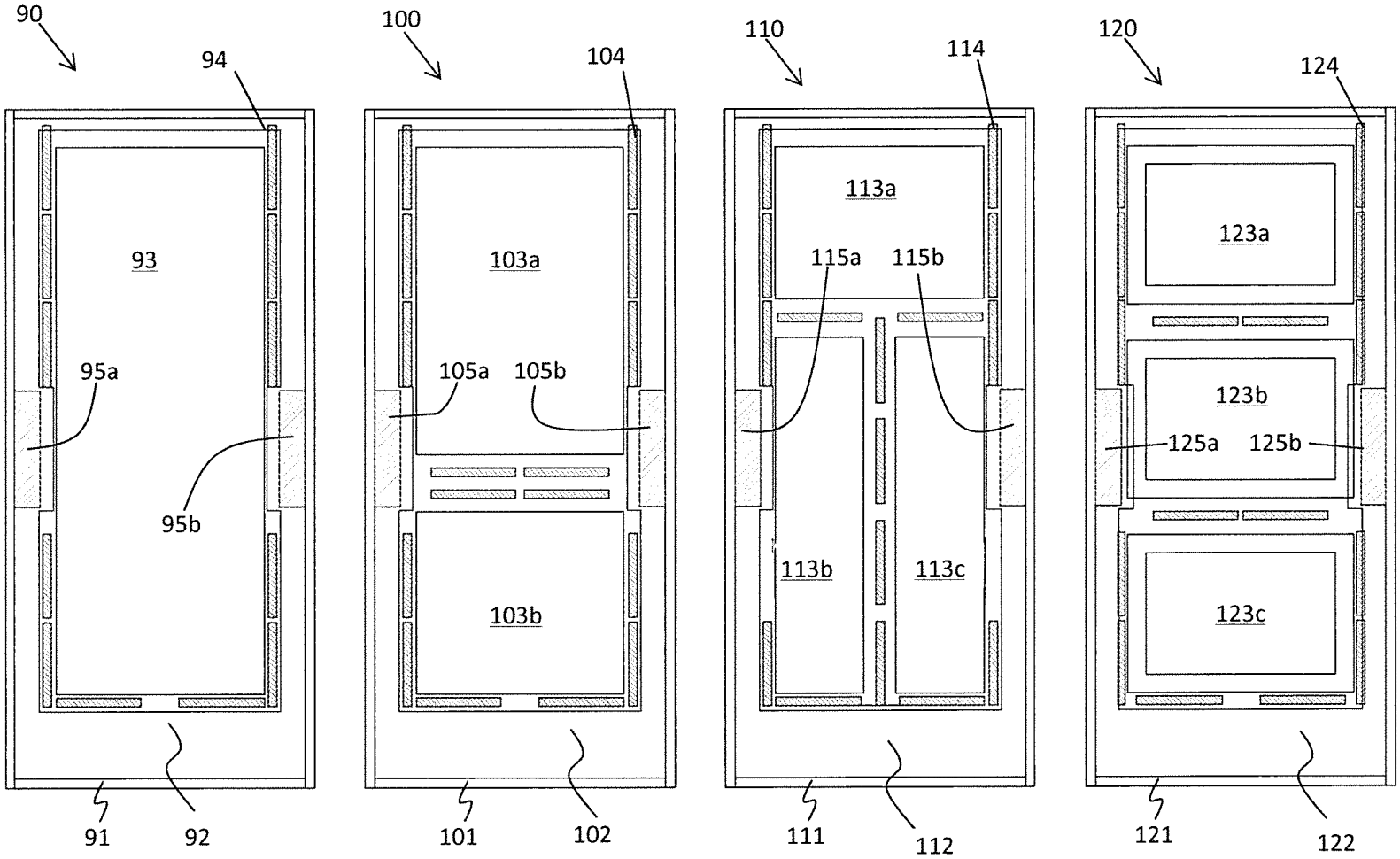
FIG. 9 is a plan view of a partially assembled paneled door according to another embodiment of the invention.
FIG. 10 is a plan view of a partially assembled paneled door according to still another embodiment of the invention.
FIG. 11 is a plan view of a partially assembled paneled door according to a further embodiment of the invention.
FIG. 12 is a plan view of a partially assembled paneled door according to a still further embodiment of the invention.

FIG. 9 is an embodiment of a partially assembled door 90 including a perimeter frame 91 and lock blocks 95*a* and 95*b* secured to an interior surface of a first raised region 92 of a first door facing having a single recessed panel 93. First core inserts 94 are positioned on opposite sides of and below the recessed panel 93. The partially assembled door 90 is ready for further assembly steps, including securing a central core component (not shown in FIG. 9) to the coplanar surfaces of the recessed panel 93 and the first core inserts 94, and securing an identical second door skin with second core inserts (not shown, but similarly pre-applied and secured to the interior surface of the second door skin) to the upward facing surfaces of the central core component and the perimeter frame 91.

FIG. 10 is an embodiment of a partially assembled door 100 including a perimeter frame 101 and lock blocks 105*a* and 105*b* secured to an interior surface of a first raised region 102 of a first door facing having two recessed panels 103*a* and 103*b*. First core inserts 104 are positioned on opposite sides of the recessed panel 103*a*, on opposite sides of and below the recessed panel 103*b*, and between the recessed panels 103*a* and 103*b*. The partially assembled door 100 is ready for further assembly steps, including securing a central core component (not shown in FIG. 10) to the coplanar surfaces of the recessed panels 103*a* and 103*b* and the first core inserts 104, and securing an identical second door skin with second core inserts (not shown, but similarly pre-applied and secured to the interior surface of the second door skin) to the upward facing surfaces of the central core component and the perimeter frame 101.

FIG. 11 is an embodiment of a partially assembled door 110 including a perimeter frame 111 and lock blocks 115*a* and 115*b* secured to an interior surface of a first raised region 112 of a first door facing having three recessed panels 113*a*, 113*b*, and 113*c*. First core inserts 114 are positioned on opposite sides of and below the recessed panels 113*a*, 113*b*, and 113*c*. The core inserts 114 are positioned at the first raised regions 112 between the recessed panels 113*a*, 113*b*, and 113*c*. The partially assembled door 110 is ready for further assembly steps, including securing a central core component (not shown in FIG. 11) to the coplanar surfaces of the recessed panels 113*a*, 113*b*, and 113*c* and the first core inserts 114, and securing an identical second door skin with second core inserts (not shown, but similarly pre-applied and secured to the interior surface of the second door skin) to the upward facing surfaces of the central core component and to the perimeter frame 111.

FIG. 12 is an embodiment of a partially assembled door 120 including a perimeter frame 121 and lock blocks 125*a* and 125*b* secured to an interior surface of a first raised region 122 of a first door facing having three recessed panels 123*a*, 123*b*, and 123*c*. First core inserts 124 are positioned on opposite sides of and below the recessed panels 123*a*, 123*b*, and 123*c*. Thus, the core inserts 124 are positioned at the first raised region 122 between the recessed panels 123*a* and 123*b*, and at the first raised region 122 between the recessed panels 123*b* and 123*c*. The partially assembled door 120 is ready for further assembly steps, including securing a central core component (not shown in FIG. 12) to the coplanar surfaces of the recessed panels 123*a*, 123*b*, and 123*c* and the first core inserts 124, and securing an identical second door skin with second core inserts (not shown, but similarly pre-applied and secured to the interior surface of the second door skin) to the upward facing surfaces of the central core component and the perimeter frame 121.

Those skilled in the art will understand that after the door 90, for example, has been assembled and central core insert(s) positioned between and adhesively connected to the associated door facings, the door 90 is held in a condition so that the adhesive will set to a point sufficient to prevent movement of the door facings and central core insert(s) relative to each other during subsequent handling and transit of the door. Thus, the door 90 or a stack of doors 90 may be maintained in a press to allow pressure to be applied to the door 90 to facilitate securing the central core insert(s) to the associated door facings. Where hot melt adhesive is used to secure the core inserts to the door facings, the hot melt adhesive achieves adequate curing relatively quickly, on the order of a few minutes or less. Where polyvinyl adhesive is used, the cure period may be 90 minutes to several hours. After the door 90 has adequately cured, it may be trimmed to size.

Figure 13:
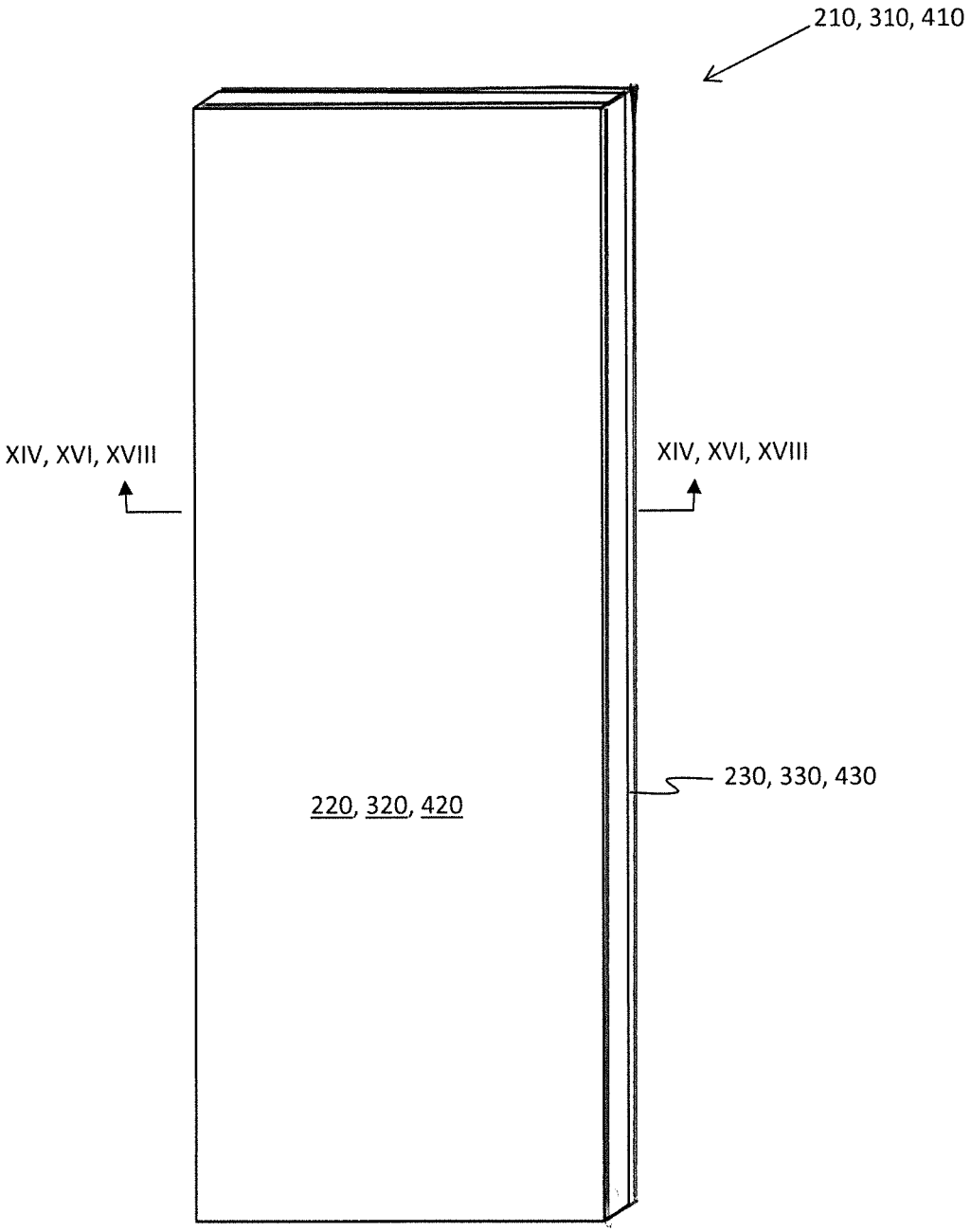
FIG. 13 is a front perspective view of a flush door according to another embodiment of the invention.
Figure 14:
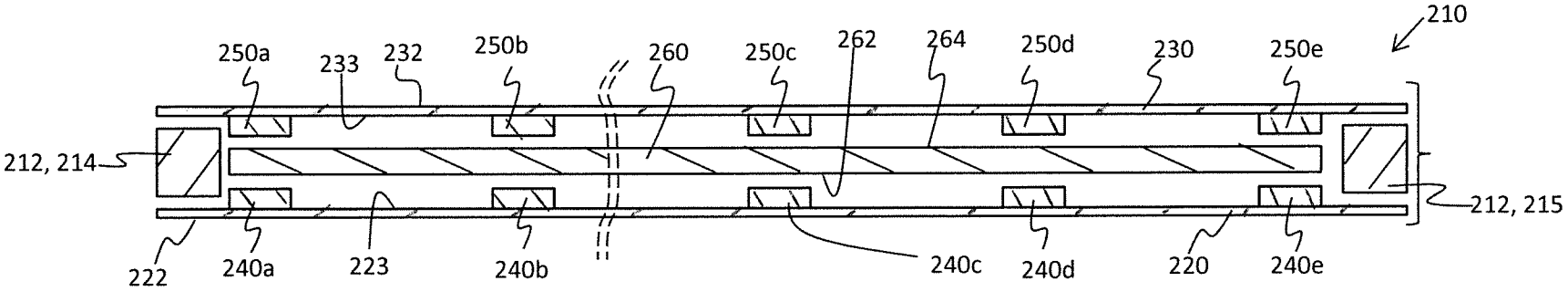
FIGS. 14 and 15 are horizontal cross-sections taken along sectional line XIV-XIV of FIG. 13 showing a partially assembled view and a fully assembled view of a flush door according to an embodiment of the invention.
Figure 15:
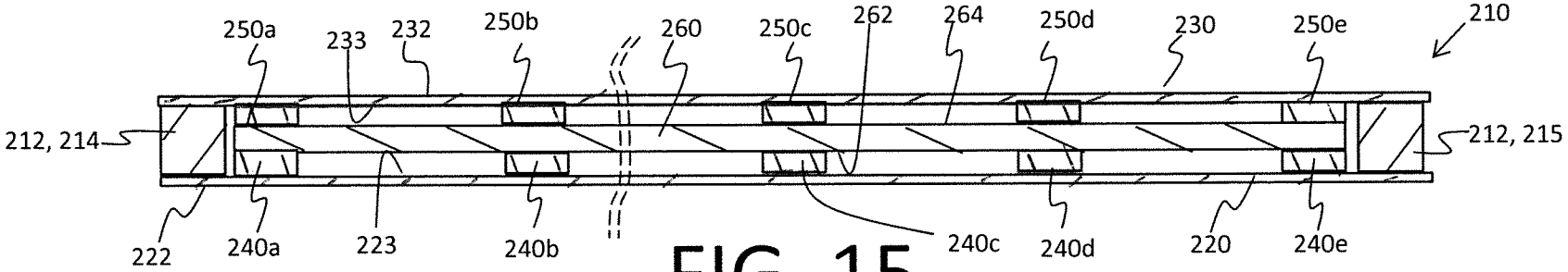

A planar (or non-paneled or flush) door according to an embodiment of the invention is generally indicated by reference numeral 210 in FIGS. 13-15, in which like reference numerals of the door 10 of the first embodiment are used to designate corresponding parts of the door 210, except with the addition of "200" to the reference numerals in FIGS. 13-15. The above description of those corresponding parts of the door 10 of the first embodiment is incorporated herein by reference.

As best shown in FIG. 15, the door 210 comprises a frame 212 including stiles 214 and 215 (shown in cross section in FIGS. 14 and 15) and top and bottom rails (not shown, but similar to rails 16 and 17) connecting the ends of the stiles 214, 215. The door 210 further comprises a first door facing 220 having a first exterior surface 222 and an opposite first interior surface 223, and a second door facing 230 having a second exterior surface 232 and an opposite second interior surface 233. The surfaces 222, 223, 232, and 233 are planar or "flush" such that they do not include any molded panels or molded transition regions.

The door 210 further includes a core comprising a central core component 260 having opposite first and second planar surfaces 262 and 264, a plurality of first core inserts 240*a*, 240*b*, 240*c*, 240*d*, and 240*e* having respective inner surfaces (unnumbered but corresponding to the inner surfaces 42 of the first embodiment) secured to the first planar surface 262 and opposite outer surfaces (unnumbered but corresponding to the outer surfaces 44 of the first embodiment) secured to the first interior surface 223, and a plurality of second core inserts 250*a*, 250*b*, 250*c*, 250*d*, and 250*e* having respective inner surfaces (unnumbered but corresponding to the inner surfaces 52 of the first embodiment) secured to the second planar surface 264 and opposite outer surfaces (unnumbered but corresponding to the outer surfaces 54 of the first embodiment) secured to the second interior surface 233. The central core component 260 preferably has a uniform thickness. Similarly, the core inserts 240*a*-240*e* and 250*a*-250*e* preferably have a uniform thickness, with the thickness of the first core inserts 240*a*-240*e* preferably equal to the thickness of the second core inserts 250*a*-250*e*. The total combined thickness of a first core insert (240*a*, 240*b*, 240*c*, 240*d*, or 240*e*), a corresponding second core insert (250*a*, 250*b*, 250*c*, 250*d*, or 250*e*), and the central core component 260 is equal to the thickness of the frame 212.

According to an exemplary embodiment of assembling the door 210 shown, in part, in FIG. 14, the outer surfaces of the first core inserts 240*a*-240*e* are secured to the interior surface 223 of the first door facing 220, and the outer surfaces of the second core inserts 250*a*-250*e* are secured to the interior surface 233 of the second door facing 230. The frame 212 is placed on and secured to the first interior surface 223, preferably after the first core inserts 240*a*-240*e* have been secured to the interior surface 223. After the first core inserts 240*a*-240*e* and the frame 212 have been secured to the interior surface 223 of the first door facing 220, the first surface 262 of the central core component 260 is secured to the inner surfaces of the first core inserts 240*a*-240*d*. Next, the second door facing 230 with the second core inserts 250*a*-250*e* already secured thereto are laid on and secured to the frame 212 and the second surface 264 of the central core component 260. According to a preferred embodiment, adhesive is applied to the opposite planar surfaces 262 and 264 of the central core component 260, but not to the inner surfaces of the first core inserts 240*a*-240*e* or the inner surfaces of the second core inserts 250*a*-250*e*.

Figure 16:
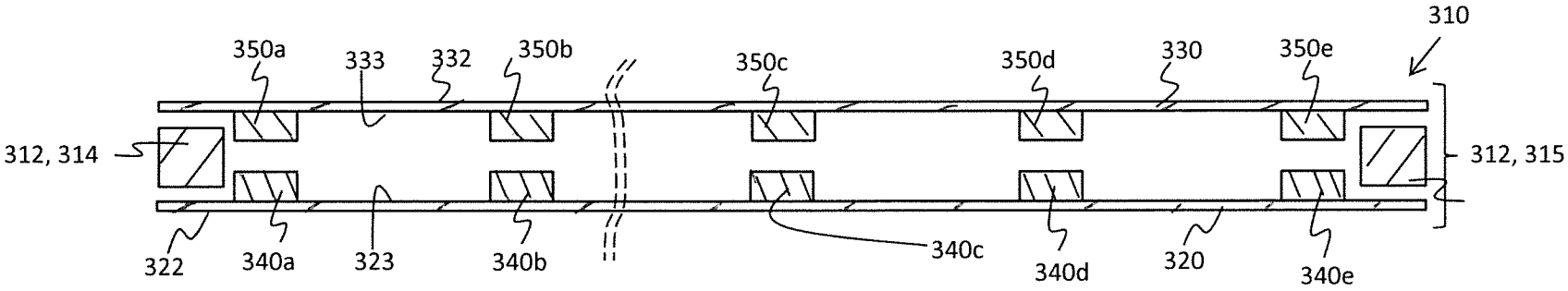
FIGS. 16 and 17 are horizontal cross-sections taken along sectional line XVI-XVI of FIG. 13 showing a partially assembled view and a fully assembled view of a flush door according to another embodiment of the invention.
Figure 17:
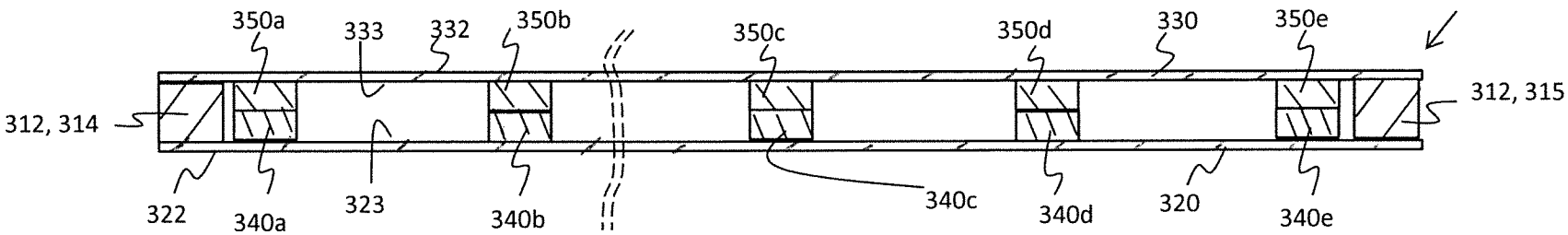

A non-paneled (or planar or flush) door according to another embodiment of the invention is generally indicated by reference numeral 310 in FIGS. 13, 16, and 17, in which like reference numerals of the door 10 of the first embodiment are used to designate corresponding parts of the door 310, except with the addition of "300" to the reference numerals in FIGS. 13, 16, and 17. The above description of those corresponding parts of the door 10 of the first embodiment is incorporated herein by reference.

As best shown in FIG. 16, the door 310 comprises a frame 312 including stiles 314 and 315 (shown in cross section in FIGS. 16 and 17) and top and bottom rails (not shown, but similar to rails 16 and 17) connecting the ends of the stiles 314, 315. The door 310 further comprises a first door facing 320 having a first exterior surface 322 and an opposite first interior surface 323, and a second door facing 330 having a second exterior surface 332 and an opposite second interior surface 333. The surfaces 322, 323, 332, and 333 are planar or "flush" such that they do not include any molded panels or molded transition regions.

The door 310 further includes a core comprising a plurality of first core inserts 340*a*, 340*b*, 340*c*, 340*d*, and 340*e* having respective inner surfaces (unnumbered but corresponding to the inner surfaces 42 of the first embodiment) and opposite outer surfaces (unnumbered but corresponding to the outer surfaces 44 of the first embodiment) secured to the first interior surface 323, and a plurality of second core inserts 350*a*, 350*b*, 350*c*, 350*d*, and 350*e* having respective inner surfaces (unnumbered but corresponding to the inner surfaces 52 of the first embodiment) secured to the inner surfaces of the first core inserts 340*a*, 340*b*, 340*c*, 340*d*, and 340*e* and opposite outer surfaces (unnumbered but corresponding to the outer surfaces 54 of the first embodiment) secured to the second interior surface 333. The core inserts 340*a*-340*e* and 350*a*-350*e* preferably have a uniform thickness, with the thickness of the first core inserts 340*a*-340*e* preferably equal to the thickness of the second core inserts 350*a*-350*e*. The total combined thickness of a first core insert (340*a*, 340*b*, 340*c*, 340*d*, or 340*e*) and a corresponding second core insert (350*a*, 350*b*, 350*c*, 350*d*, or 350*e*) is equal to the thickness of the frame 312.

According to an exemplary embodiment of assembling the door 310 shown, in part, in FIG. 16, the outer surfaces of the first core inserts 340*a*-340*e* are secured to the interior surface 323 of the first door facing 320, and the outer surfaces of the second core inserts 350*a*-350*e* are secured to the interior surface 333 of the second door facing 330. The frame 312 is placed on and secured to the first interior surface 323, preferably after the first core inserts 340*a*-340*e* have been secured to the interior surface 323. After the first core inserts 340*a*-340*e* and the frame 312 have been secured to the interior surface 323 of the first door facing 320, the second door facing 330 with the second core inserts 350*a*-350*e* already secured thereto are laid on and secured to the frame 312 so that the inner surfaces of the second core inserts 350*a*-350*e* are placed on and secured to the inner surfaces of the first core inserts 340*a*-340*e*.

Figure 18:
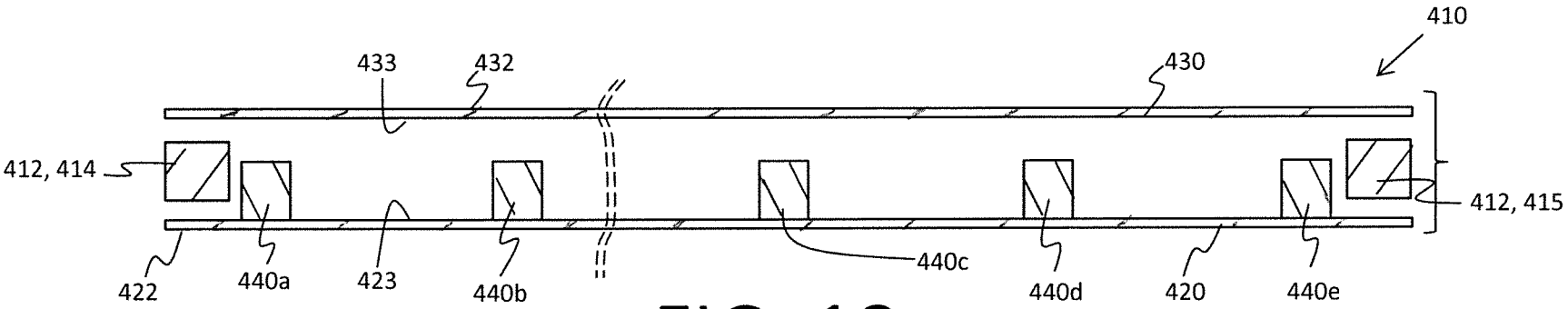
FIGS. 18 and 19 are horizontal cross-sections taken along sectional line XVIII-XVIII of FIG. 13 showing a partially assembled view and a fully assembled view of a flush door according to a further embodiment of the invention.
Figure 19:
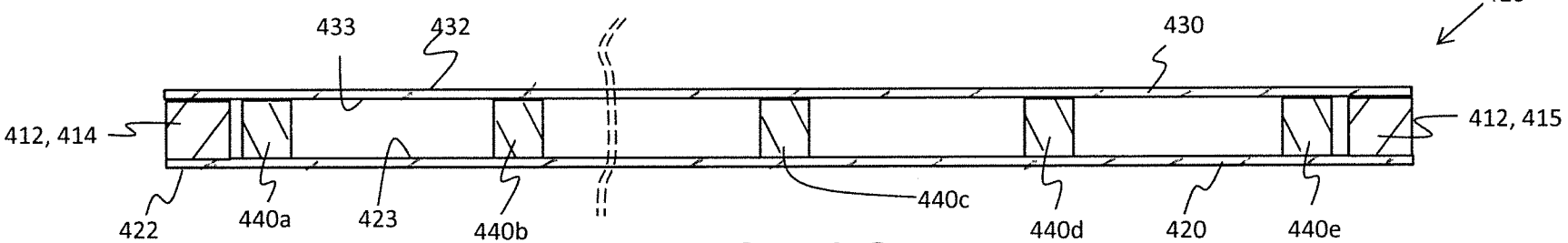
Figure 20:
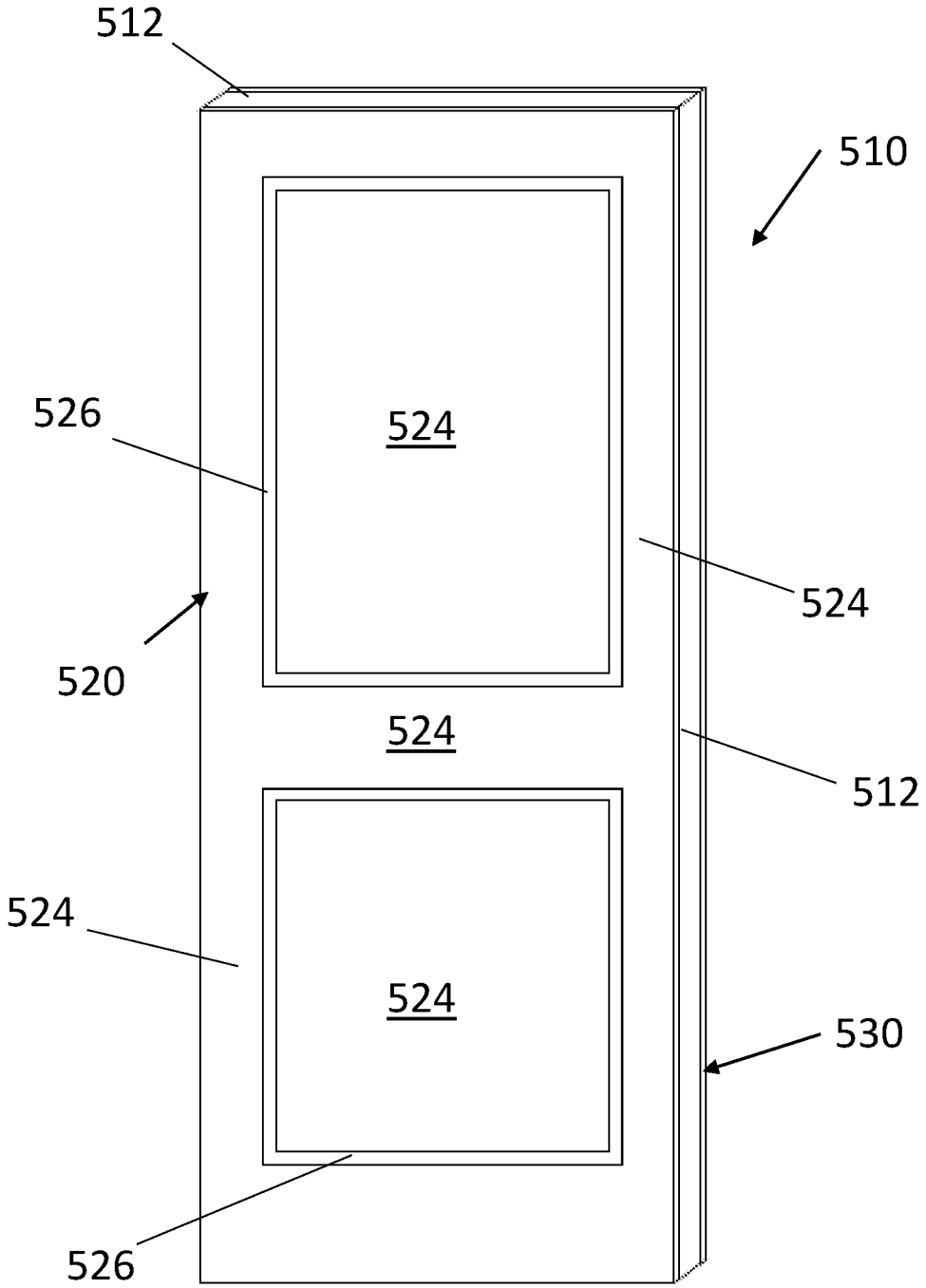
FIG. 20 is a front perspective view of a panel door according to a further embodiment of the invention.

A planar (or flush or non-paneled) door according to a further embodiment of the invention is generally indicated by reference numeral 410 in FIGS. 13, 18, and 19, in which like reference numerals of the door 10 of the first embodiment are used to designate corresponding parts of the door 410, except with the addition of "400" to the reference numerals in FIGS. 13, 18, and 19. The above description of those corresponding parts of the door 10 of the first embodiment is incorporated herein by reference.

As best shown in FIG. 19, the door 410 comprises a frame 412 including stiles 414 and 415 (shown in cross section in FIGS. 18 and 19) and top and bottom rails (not shown, but similar to rails 16 and 17) connecting the ends of the stiles 414, 415. The door 410 further includes a first door facing 420 having a first exterior surface 422 and an opposite first interior surface 423, and a second door facing 430 having a second exterior surface 432 and an opposite second interior surface 433. The surfaces 422, 423, 432, and 433 are planar or "flush" such that they do not include any molded panels or molded transition regions.

The door 410 further comprises a core including a plurality of core inserts 440*a*, 440*b*, 440*c*, 440*d*, and 440*e* having respective first surfaces secured to the first interior surface 423 of the first door facing 420 and respective opposite second surfaces secured to the second interior surface 433 of the second door facing 430. The thickness of the core inserts 440*a*-440*e* between the opposite first and second surfaces is equal to the thickness of the frame 412.

We prefer that the core inserts 440*a*, 440*b*, 440*c*, 440*d*, and 440*e* be secured to the associated door facings 420, 430 through the combination of polyvinyl acetate (PVA) with a pressure sensitive adhesive (PSA). The PSA has rapid setting functionality in order to secure the core inserts 440*a*, 440*b*, 440*c*, 440*d*, and 440*e* to the door facings 420, 430 and to maintain them secured to the facings. The PVA takes longer to achieve its final cure strength, which is sufficient to maintain the door facings secured to the core inserts 440*a*, 440*b*, 440*c*, 440*d*, and 440*e* and to the peripheral frame. While the PVA and PSA are separately applied, they may be applied adjacent to each other. We have found that PVA should not be used with hot melt adhesives, such as PUR, because their reaction conditions interfere with each other. The PSA employed may be chosen from commercially available adhesives and can be cured subsequent to coating using any of a number of crosslinking mechanisms such as ionic, hydrogen bonding, chemical, or mixtures thereof and using stimuli such as thermal, UV, IR, or EB radiation. Any of a number of PSAs from suppliers such as Dow, Henkel, BASF, HB Fuller and Avery Dennison can be used with the present invention. Some examples of PSAs that can be used are 82674, HL 2081, HL 8005X, and HL 2811-PW from H.B. Fuller; and FA 20, Hammerlock, R128, Z3000, AT20, AT20A, and E898 from Avery Dennison. The preferred PSA is 82674 from H.B. Fuller.

According to an exemplary embodiment of assembling the door 410 shown, in part, in FIG. 18, the first surfaces of the core inserts 440*a*, 440*b*, 440*c*, 440*d*, and 440*e* are secured to the interior surface 423 of the first door facing 420. The PVA/PSA adhesives may be applied to the core inserts 440*a*, 440*b*, 440*c*, 440*d*, and 440*e* or to the locations on the door facing 420 where the core inserts 440*a*, 440*b*, 440*c*, 440*d*, and 440*e* are to be located. The frame 412 is placed on and secured to the first interior surface 423 after the core inserts 440*a*-440*e* have been secured to the interior surface 423. After the first core inserts 440*a*-440*e* and the frame 412 have been secured to the interior surface 423 of the first door facing 420, the PVA/PSA adhesives may be applied to the exposed surfaces of the core inserts 440*a*, 440*b*, 440*c*, 440*d*, and 440*e* or to the locations on the door facing 430 where the core inserts 440*a*, 440*b*, 440*c*, 440*d*, and 440*e* are to be located. The second door facing 430 may then be laid on and secured to the frame 412 and the second surfaces of the core inserts 450*a*-450*e* abut and are secured to the second interior surface 433.

The door 410 eliminates the central core of the previous embodiments and provides direct connection and support between the door facings 420, 430. The core inserts 440*a*, 440*b*, 440*c*, 440*d*, and 440*e* are a uniform thickness and may also be a uniform length and width to minimize inventory management. Thus, for example, a relatively simple pick and place robot may be used to move the core inserts 440*a*, 440*b*, 440*c*, 440*d*, and 440*e* from their storage location and position them where needed on the door facing 420.

FIGS. 20-25 illustrate a door 510 contains paneled door facings 520, 530 having raised regions 524, 534 that are connected by recessed regions 526, 536. Preferably, the door facings 520, 530 are mirror images of each other. The door 510 comprises a frame 512 including stiles and rails 514 and 515, respectively. The door 510 further comprises a first door facing 520 having a first exterior surface 522 and an opposite first interior surface 523, and a second door facing 530 having a second exterior surface 532 and an opposite second interior surface 533 (see FIGS. 23 and 25). The first door facing 520 has raised regions 524 that are coplanar with each other, and recessed regions 526 that are recessed from the raised regions 524. This embodiment differs from that shown in FIGS. 1-5 in that there are no coplanar recessed panels, such as those shown as 28 in FIGS. 1-5. The raised regions 524 form panels instead. Each of the recessed regions 526 preferably contain a first slope 525 and a second slope 527 (see FIGS. 23 and 25). The first and second slopes 525 and 527 are directly connected to each other and meets at a bottom 528 of the recessed region 526, with the first slope 525 continuous with and connected to the first raised portion 524 and the up slope 527 continuous with and connected to the second raised portion 524. The second door facing 530 is a mirror image of the first door facing and similarly contains its own raised regions 534, recess regions 536, first slope 535, second slope 537, and bottom 538. Overall, the recessed regions 526, 536 of the first and second door facings 520, 530 connects adjacent raised portions 524, 534, respectively. The slopes 525, 527, 535, 537 may be a straight line directly to the bottom 528, 538 or may include contours as they recess to the bottom 528, 538. The bottoms 528, 538 may be substantially V-shaped as illustrated in FIGS. 22-25; however, the present invention also contemplate bottoms 528, 538 containing other shapes, such as U-shape. The distance between the interior surfaces 523, 533 at the recessed regions 526, 536 is less than at the raised regions 524, 534, preferably about 0.600 inch (1.52 cm) to about 0.880 inch (2.24 cm) less.

The raised regions 524, 534 form co-planar panels on the door 510. FIGS. 20-25 shows a two-panel door, where a raised region 524, 234 forming a panel with a recessed region 526, 536 surrounding the panel. Although FIGS. 20-25 depict a two-panel door, a skilled person in the art will recognize that doors with other than two panels, such as one, three, four, five, six, or more panels, may similarly be similarly formed with raised regions 524, 534 forming the panels, while recessed regions 526, 536 surrounding the raised regions 5224, 534. Similarly, while the door 510 has raised panels 524, 534, the principles apply to a door having recessed panels.

The door 510 further includes a plurality of core inserts 540 positioned between the raised portions 524 and 534. However, because the recess regions 526, 536 include no horizontally planar recess panels, core inserts 540 are not placed between the recess regions 526 and 536. The core inserts 540 are substantially similar to the core inserts 440 disclosed above. The thickness of the core inserts 540 is preferably uniform and equal to the thickness of the frame 512, preferably about 1.125 inches (2.86 cm). Each core insert 540 also has a width approximately equal to the thickness, preferably about 1.125 inches (2.86 cm), and a length of about 5 (12.7 cm) inches to about 20 inches (50.8 cm), preferably about 10 inches (25.4 cm). Preferably a core insert 540 has dimensions of 1.125 inches×1.125 inches×5 inches to 1.125 inches×1.125 inches×20 inches, most preferably 1.125 inches×1.125 inches×10 inches. The core inserts 540 are preferably made of expanded polystyrene or other suitable material. While we prefer that the core inserts are rectangular in plan, they may have other shapes such as circular, oval, triangular, etc, provided that they span and are securable to the opposed door facings 520, 530 in order to prove support thereto.

Figure 21:
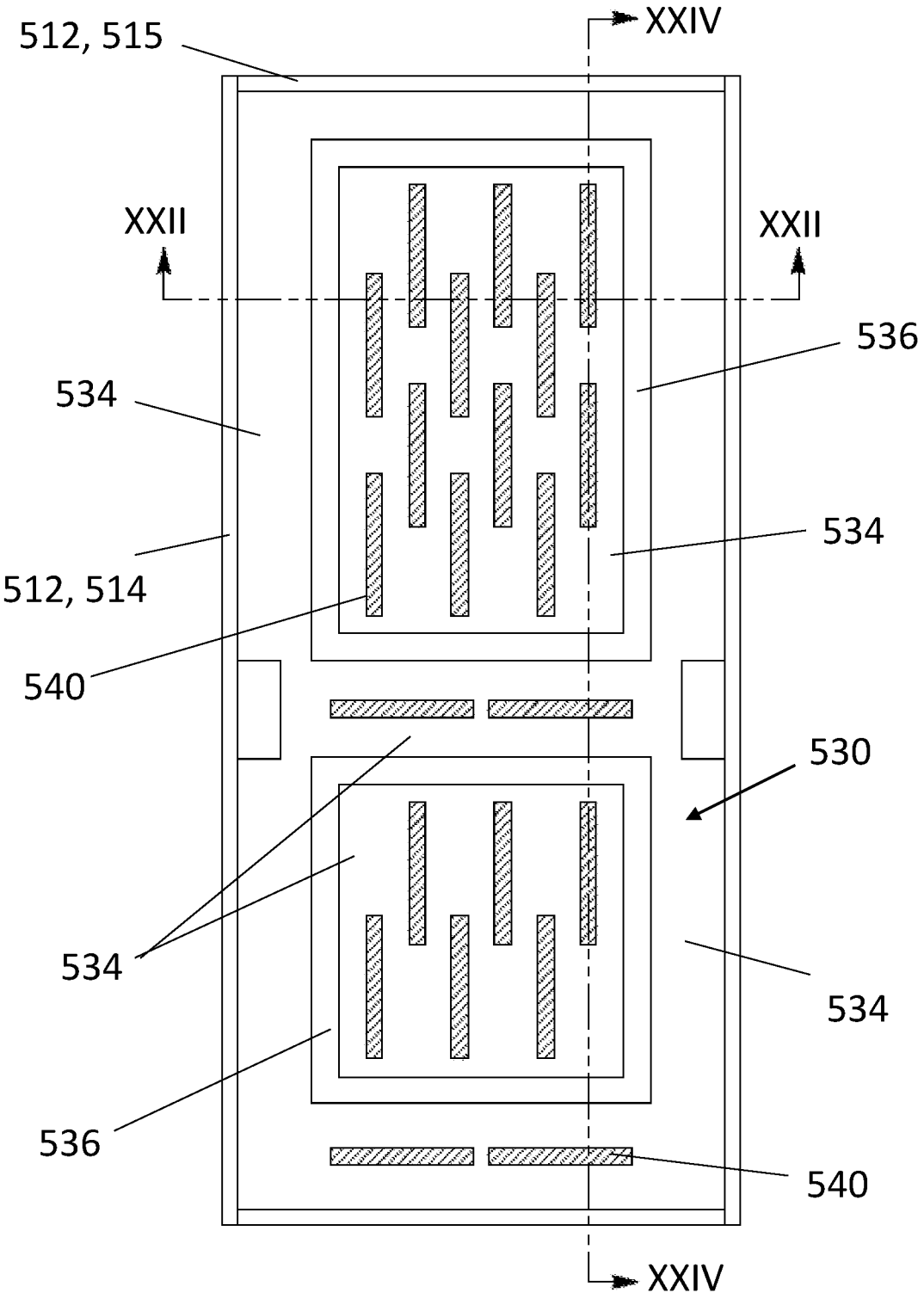
FIG. 21 is a plan view of the door of FIG. 20 with the first door facing removed.
Figure 22:
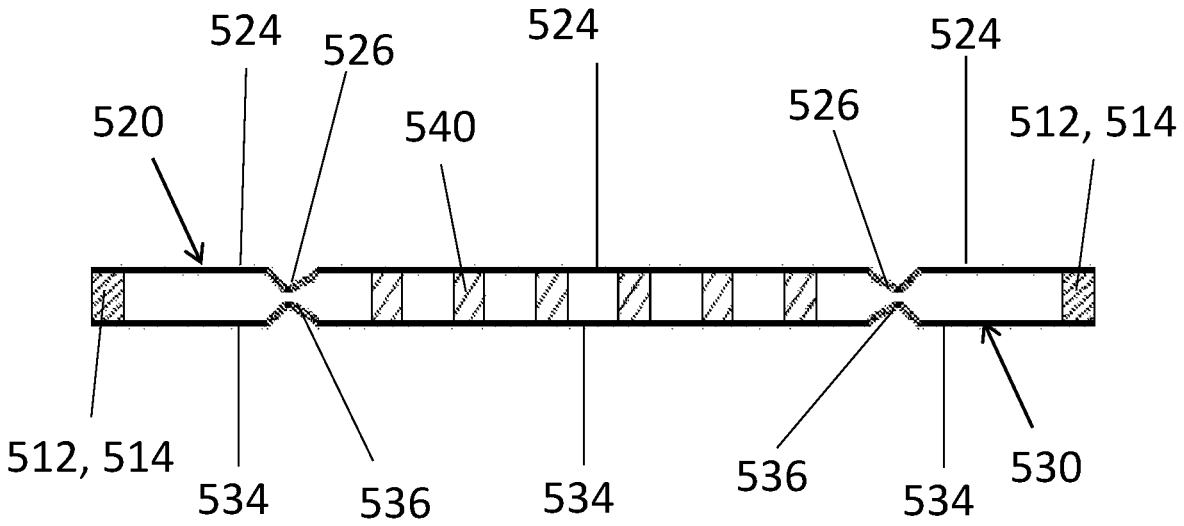
FIG. 22 is a cross-section of the door of FIG. 20 taken along sectional line XXII-XXII (shown in FIG. 21)
Figure 23:
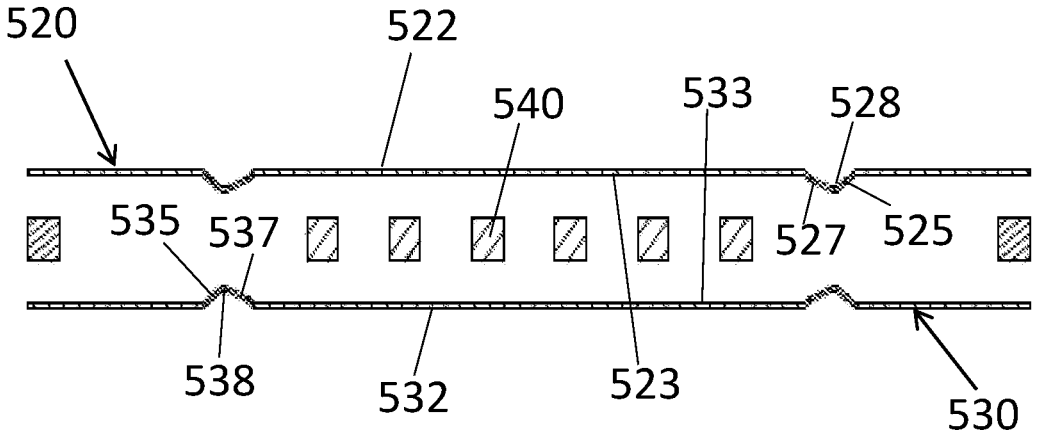
FIG. 23 is an exploded view of FIG. 22.
Figure 24:
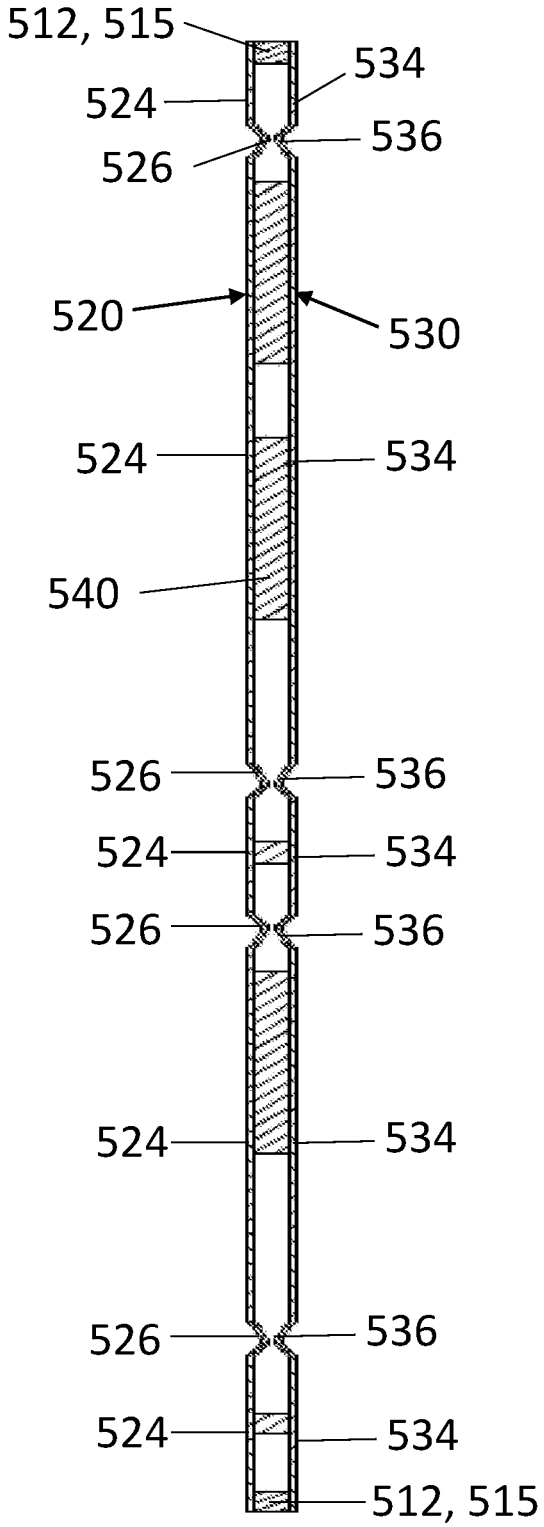
FIG. 24 is a cross-section of the door of FIG. 20 taken along sectional line XXIV-XXIV (shown in FIG. 21)
Figure 25:
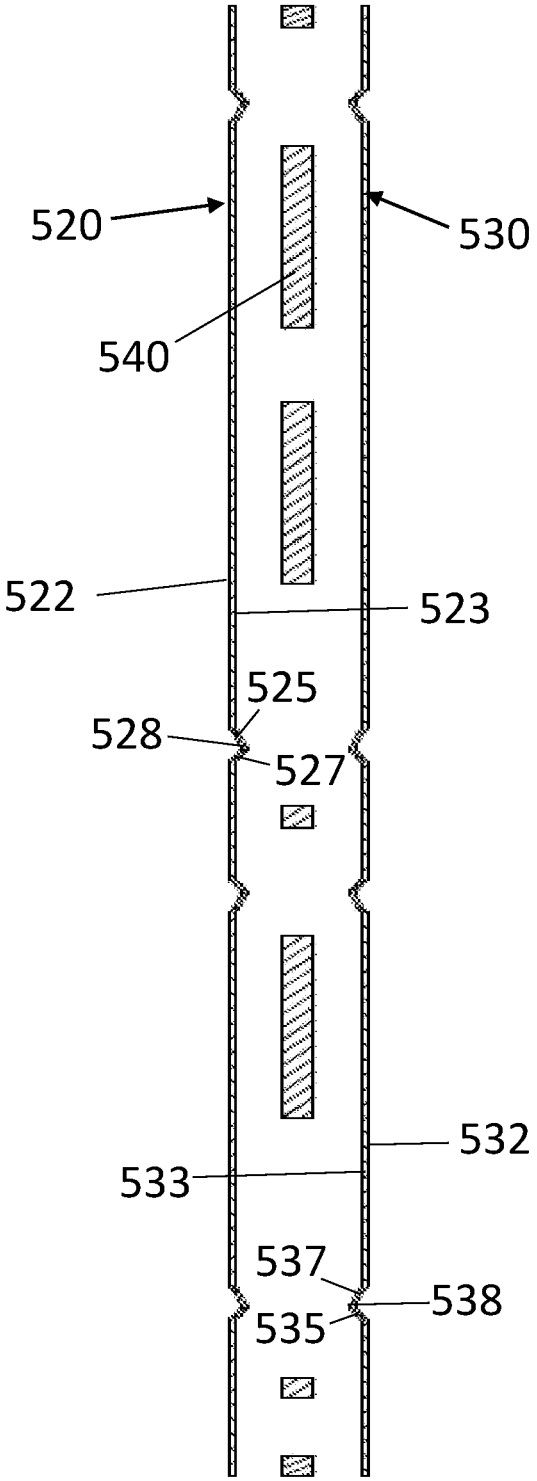
FIG. 25 is an exploded view of FIG. 23.

The first surfaces of the core inserts 540 are adhesively secured by the PSA/PVA to the interior surface 533 of the second door facing 530 in the raise portions 534 of the second door facing 530. FIG. 21 shows an exemplary arrangement of the core inserts 540 on the second door facing 530. The core inserts 540 are arranged to minimize the number of core inserts 540 to achieve a stable and distortion resistant door. The optimum pattern may vary with the particular door design and size. The frame 512 is also placed on and secured to the first interior surface 533, either during, before, or after the core inserts 540 have been secured to the interior surface 433. After the core inserts 540 and the frame 412 have been secured to the interior surface 533 of the second door facing 530, the first door facing 520 is laid on and secured to the frame 512 so that the second surfaces of the core inserts 540 abut and are also adhesively secured by the PSA/PVA to the first interior surface 523 of the first door facing 520. While we prefer that the inserts 540 be secured to the door facing 520 with the PSA/PVA, the adhesive may for the second or top facing 520 be a hot melt, such as PUR. Because the inserts 540 are initially secured to door facing 530 by the PSA/PVA combination, they are secured in position in door facing 530 and thus are not movable when the facing 520 is applied.

FIGS. 22-25 illustrate the door 510 in cross section with the core inserts 540 disposed between facings 520,530. It can be seen in FIGS. 22 and 24 that the core inserts 540 span the distance between the interior surfaces of the door facings 520,530. Because the core inserts 540 span the distance between the opposed door facings, the inserts 540 provide structural support to the door facings 520,530 in order to reduce distortion as could be caused by moisture differentials, such as may arise with exterior doors where one door facing is disposed within a building and the other door facing is exposed to the elements. Similarly, the core inserts 540 can be formed from materials that attenuate noise and/or to control thermal flux through the door.

Figure 26:
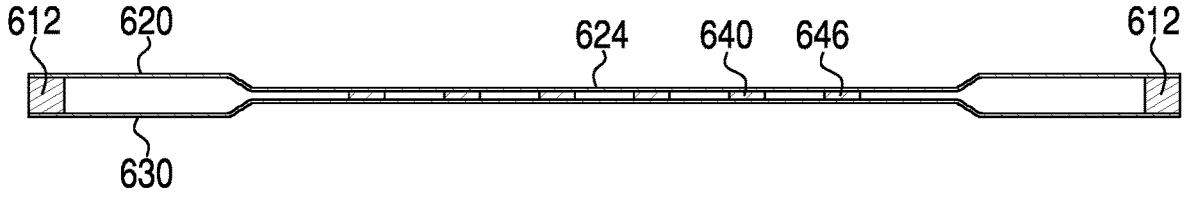
FIG. 26 is a horizontal cross sectional view of a paneled door.
Figure 27:
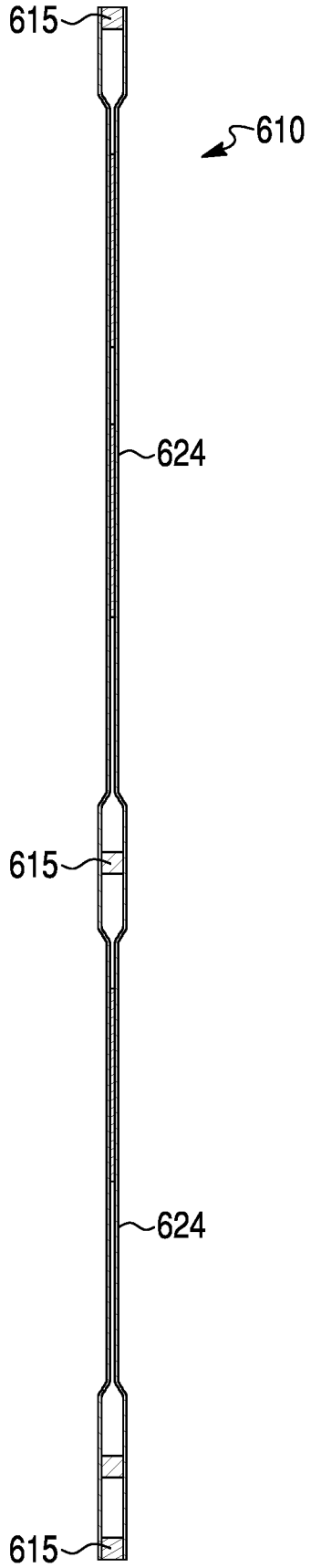
FIG. 27 is a vertical cross sectional view of the door of FIG. 26.

Door 610 of FIGS. 26-27 is a paneled door similar to the door 510, with the principal difference being that the door 610 has upper and lower recessed panels 624. Door 610 has stiles 612 and rails 615 at opposite ends of stile 612 and also a center rail 615, as best shown in FIG. 27. Door 610 has a plurality of spaced, vertically extending core inserts 640 disposed in parallel. Unlike the core elements 540 that have a thickness equal to the thick of stiles 512 and rails 515, the core elements 640 have a thickness less than the thickness of the stiles 612 and rails 615 because the panels 624 are recessed from the top plan of door facings 620, 630. The core elements 640 span the distance between the interior surfaces of door facing 620, 630 and are adhesively secured to the door facings 620, 630.

The core elements 640 may be arrayed in a staggered orientation like the core elements 540 of door 510, as best shown in FIG. 21. As illustrated in FIG. 21, the core elements 540 are arrayed in an alternating pattern. Referring to the upper panel 534 of FIG. 21, the core elements 540 are arranged in a plurality of horizontally and vertically offset sets of core elements 540. A first set of three core elements 540 extend vertically in spaced parallel array. The next set of three core inserts 540 are vertically advanced relative to the first set and are disposed between the core inserts 540 of the first set. The next set of three core inserts 540 are vertically advanced relative to the core inserts of the second set, disposed between the core inserts 540 of the second set and aligned vertically with the core inserts 540 of the first set. The next or fourth set of three core inserts 540 are vertically advanced relative to the third set and are disposed between the core inserts 540 of the third set and aligned vertically with the core inserts 540 of the second set. A similar array of interleaved spaced, parallel core inserts 540 is applied to lower panel 534.

While we disclose four sets of staggered core inserts 540 for upper panel 534, a larger or fewer number of sets of inserts may be used depending upon the size of the panel, as is illustrated for the panels 534 of FIG. 21, where the upper panel has four sets and the lower panels has two sets. It can be seen in FIG. 21 that the upper panel 534 is larger than the lower panels. The lower panel thus does not require as many core inserts in order to maintain structural soundness. Also, while we prefer that the core inserts 540 and 640 be arrayed in the staggered pattern of FIG. 21, they need not be staggered and may, for example, substantially span the vertical dimension of the panel to which they are attached. An advantage of the staggered orientation is that core inserts having a common length may be utilized.

An advantage of the disclosed invention is a reduction in assembly time, particularly where the opposite planar surfaces of the core inserts 540 are coated with adhesive. Thus, fewer parts are passed through the glue spreader or other device used to apply the adhesive.

Another advantage is that the same (universal) identical core inserts may be used for various door facings having different panel arrangements. Consequently, the same universal parts may be fed into the assembly process without requiring advanced notice of the panel arrangements, panel sizes, and the number of panels of the door facings. This advantage is particularly helpful for assembly processes that include manual feeding steps. The tasks of the person or persons feeding parts to the assembly process and assembling the door are simplified.

Another advantage of exemplary embodiments is that changing the assembly process to accommodate different door designs can be performed more quickly and simply because the same universal central core component and/or core inserts may be used for various door panel arrangements.

The various components and features of the above-described exemplary embodiments may be substituted into one another in any combination. It is within the scope of the invention to make the modifications necessary or desirable to incorporate one or more components and features of any one embodiment into any other embodiment.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to necessarily limit the invention to the precise embodiments disclosed.

What is claimed is:

1. A method of making a door, comprising:

a) providing a first door facing having a first panel region, the first door facing having an interior surface and an exterior surface;

b) adhesively securing a plurality of foam core inserts to the interior surface in the first panel region;

c) providing a door frame, and adhesively securing the door frame about the first door facing;

d) providing a second door facing having a second panel region, the second door facing having an interior surface and an exterior surface; and e) adhesively securing the second door facing to the foam core inserts and to the door frame, wherein the interior surface of the second door facing faces the interior surface of the first door facing and each of the foam core inserts has a thickness sufficient to span the distance between the interior surfaces of the first and second door facings, wherein the foam core inserts are secured to the second door facing with an adhesive that is a different type than the adhesive used to secure the first door facing to the core inserts.

2. The method of claim 1, including the step of securing the foam core inserts in a spaced relationship relative to adjacent foam core inserts.

3. The method of claim 1, including providing the foam core inserts that are rectangular in plan and orienting the foam core inserts in a vertically spaced, parallel array.

4. The method of claim 3, wherein the step of securing the door frame occurs during, before, or after step b).

5. The method of claim 1, wherein the foam core inserts have a thickness that is the same as that of the door frame.

6. The method of claim 1, wherein the adhesive securing the foam core inserts to the first door facing is PVA and/or PSA and the adhesive securing the foam core inserts to the second door facing is hot melt adhesive.

7. The method of claim 1, wherein the adhesive securing the foam core inserts to the first door facing is PVA and/or PSA.

8. The method of claim 7, including the step of applying PVA and PSA in spaced relationship.

9. The method of claim 7, including the step of applying the PVA and/or PSA to one of the first door facing and the foam core inserts and applying the adhesive to the foam core inserts secured to the second door facing.

10. The method of claim 1, including the step of providing foam core inserts that are of uniform dimensions.

11. The method of claim 1, including the step of providing first and second door facings each having a plurality of panel regions and adhesively securing the foam core inserts in spaced arrays on the panel regions.

12. The method of claim 1, including the step of providing first and second door facings each having one of a raised panel region and a recessed panel region, the foam core inserts spanning between the panel regions.

13. The method of claim 1, including providing foam core inserts formed from expanded polystyrene.

14. The method of claim 1, including providing foam core inserts having a length dimension exceeding the thickness and width dimensions.

15. A method of making a paneled door, comprising:

a) providing a first door facing having a first raised panel region, the first door facing having an interior surface and an exterior surface;

b) adhesively securing a plurality of foam core inserts formed from a polymer material to the interior surface in at least the first panel region;

c) providing a door frame, and adhesively securing the door frame about the first door facing;

d) providing a second door facing having a second raised panel region, the second door facing having an interior surface and an exterior surface; and e) adhesively securing the second door facing to the foam core inserts and to the door frame, wherein the interior surface of the second door facing faces the interior surface of the first door facing and the foam core inserts have a thickness sufficient to span the distance between the interior surfaces of the first and second door facings, wherein the foam core inserts are secured to the second door facing with an adhesive that is a different type than the adhesive used to secure the first door facing to the core inserts.

16. The method of claim 15, including providing foam core inserts having a thickness corresponding to the thickness of the frame.

17. The method of claim 16, including the step of providing PVA and PSA in spaced relation onto one of the first panel region and the foam core inserts and providing a hot melt adhesive on the foam core inserts for securing the foam core inserts to the second panel region.

* * * * *